US009855474B2

(12) United States Patent
Beno et al.

(10) Patent No.: US 9,855,474 B2
(45) **Date of Patent: *Jan. 2, 2018**

(54) GOLF CLUB HEAD WITH ACCESSIBLE INTERIOR

(71) Applicant: Cobra Golf Incorporated, Carlsbad, CA (US)

(72) Inventors: Tim A. Beno, San Diego, CA (US); Karl A. Clausen, Carlsbad, CA (US); Andrew Curtis, San Diego, CA (US); Cameron J. Day, Aliso Vaiejo, CA (US); Caleb Kroloff, San Diego, CA (US); Douglas E. Roberts, Carlsbad, CA (US); Richard Romo Sanchez, Temecula, CA (US); Peter L. Soracco, Carlsbad, CA (US); Michael S. Yagley, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/243,318

(22) Filed: Aug. 22, 2016

(65) Prior Publication Data

US 2016/0354658 A1 Dec. 8, 2016

Related U.S. Application Data

(63) Continuation of application No. 14/258,694, filed on Apr. 22, 2014, now Pat. No. 9,421,438, which is a (Continued)

(51) Int. Cl.
*A63B 53/04* (2015.01)
*A63B 53/06* (2015.01)
(Continued)

(52) U.S. Cl.
CPC ..... *A63B 53/0466* (2013.01); *A63B 53/047* (2013.01); *A63B 53/06* (2013.01);
(Continued)

(58) Field of Classification Search
CPC ... A63B 53/0466; A63B 53/06; A63B 53/047; A63B 60/42; A63B 2053/0491;
(Continued)

(56) References Cited

U.S. PATENT DOCUMENTS 713,845 A 11/1902 Braid
1,253,700 A 1/1918 Mclaughlin
(Continued)

FOREIGN PATENT DOCUMENTS

JP 8-089603 A 4/1996
JP 9-192269 A 7/1997
(Continued)

OTHER PUBLICATIONS

European Search Report for EP Appl. No. 10013627 4-2318 dated Mar. 22, 2011 (8 pages).
(Continued)

*Primary Examiner* — Sebastiano Passaniti
(74) *Attorney, Agent, or Firm* — Brown Rudnick LLP; Mark S. Leonardo

(57) ABSTRACT

The invention provides a golf club head that includes a weight adjustment system inside of the club head. Preferably, when the club is played, no part of the adjustment system is directly accessible or exposed to an exterior of the club. The club head may include a panel that opens or is removable, or the club head may be disassembled to provide access to the internal weight adjustment system. A weight adjustment system generally includes at least one mechanism by which a mass distribution of the golf club head can be changed.

13 Claims, 22 Drawing Sheets

Related U.S. Application Data continuation-in-part of application No. 14/150,035, filed on Jan. 8, 2014, now Pat. No. 9,393,471, which is a continuation-in-part of application No. 13/545,329, filed on Jul. 10, 2012, now abandoned, which is a continuation-in-part of application No. 13/539,958, filed on Jul. 2, 2012, said application No. 13/545,329 is a continuation-in-part of application No. 13/407,087, filed on Feb. 28, 2012, now abandoned, which is a continuation-in-part of application No. 12/643,154, filed on Dec. 21, 2009, now Pat. No. 8,147,354, said application No. 13/545,329 is a continuation-in-part of application No. 13/185,324, filed on Jul. 18, 2011, now Pat. No. 8,226,499, which is a continuation of application No. 12/696,468, filed on Jan. 29, 2010, now Pat. No. 7,980,964, which is a continuation of application No. 11/110,733, filed on Apr. 21, 2005, now Pat. No. 7,658,686.

(60) Provisional application No. 61/513,509, filed on Jul. 29, 2011.

(51) Int. Cl.

| | |
|---|---|
| ***A63B 69/36*** | (2006.01) |
| ***A63B 60/42*** | (2015.01) |
| *A63B 53/02* | (2015.01) |
| *A63B 71/06* | (2006.01) |
| *A63B 60/52* | (2015.01) |
| *A63B 60/00* | (2015.01) |
| *A63B 60/54* | (2015.01) |

(52) U.S. Cl.

CPC ..... *A63B 60/42* (2015.10); *A63B 60/52* (2015.10); *A63B 60/54* (2015.10); *A63B 2053/023* (2013.01); *A63B 2053/045* (2013.01); *A63B 2053/0416* (2013.01); *A63B 2053/0433* (2013.01); *A63B 2053/0437* (2013.01); *A63B 2053/0491* (2013.01); *A63B 2060/002* (2015.10); *A63B 2071/0694* (2013.01); *A63B 2209/00* (2013.01); *A63B 2209/08* (2013.01); *A63B 2209/10* (2013.01); *A63B 2220/18* (2013.01); *A63B 2220/40* (2013.01); *A63B 2220/64* (2013.01); *A63B 2225/50* (2013.01); *A63B 2225/54* (2013.01)

(58) Field of Classification Search

CPC .... A63B 2053/0433; A63B 2053/0416; A63B 2209/00; A63B 2209/10; A63B 2053/45; A63B 2053/0437; A63B 2053/023; A63B 2071/0694; A63B 2209/08; A63B 2220/18; A63B 2220/40; A63B 2220/64; A63B 2225/50; A63B 2225/54; A63B 60/52; A63B 2060/002; A63B 60/54

USPC ..... 473/324–350, 287–292, 219–256

See application file for complete search history.

(56) References Cited

U.S. PATENT DOCUMENTS

| | | | |
|---|---|---|---|
| 1,349,806 | A | 8/1920 | Booth |
| 1,361,258 | A | 12/1920 | Horton |
| 1,412,650 | A | 4/1922 | Booth |
| 1,452,845 | A | 4/1923 | Pryde |
| 1,455,379 | A | 5/1923 | Allen |
| 1,552,297 | A | 9/1925 | Harness |
| 1,559,299 | A | 10/1925 | Barach |
| 1,574,213 | A | 2/1926 | Tyler |
| 1,575,364 | A | 3/1926 | Hodgkins |
| 1,665,523 | A | 4/1928 | Boyce |
| 1,705,997 | A | 3/1929 | Williams |
| 1,879,117 | A | 9/1932 | Davidson |
| 2,076,340 | A | 4/1937 | William |
| 2,163,091 | A | 6/1939 | Held |
| 2,171,383 | A | 8/1939 | Wettlaufer |
| 3,096,982 | A | 7/1963 | Bassin |
| 3,166,320 | A | 1/1965 | Onions |
| 3,524,646 | A | 8/1970 | Wheeler |
| 3,556,533 | A | 1/1971 | Hollis |
| 3,640,534 | A | 2/1972 | Mills |
| 3,692,306 | A | 9/1972 | Glover |
| 3,866,348 | A | 2/1975 | Roby et al. |
| 3,941,390 | A | 3/1976 | Hussey |
| 3,966,210 | A | 6/1976 | Rozmus |
| D240,644 | S | 7/1976 | Manfrin |
| 3,979,123 | A | 9/1976 | Belmont |
| 3,985,363 | A | 10/1976 | Jepson et al. |
| 4,021,047 | A | 5/1977 | Mader |
| 4,043,563 | A | 8/1977 | Churchward |
| 4,052,075 | A | 10/1977 | Daly |
| 4,063,737 | A | 12/1977 | Tom et al. |
| 4,067,572 | A | 1/1978 | Coleman |
| 4,085,934 | A | 4/1978 | Churchward |
| 4,193,601 | A | 3/1980 | Reid, Jr. et al. |
| 4,194,739 | A | 3/1980 | Thompson |
| D262,049 | S | 11/1981 | Simmons |
| 4,313,607 | A | 2/1982 | Thompson |
| 4,325,553 | A | 4/1982 | Taylor |
| 4,340,230 | A | 7/1982 | Churchward |
| 4,385,467 | A | 5/1983 | Samuels |
| 4,432,549 | A | 2/1984 | Zebelean |
| 4,438,931 | A | 3/1984 | Motomiya |
| 4,502,687 | A | 3/1985 | Kochevar |
| 4,653,756 | A | 3/1987 | Sato |
| 4,714,577 | A | 12/1987 | Nagamoto et al. |
| 4,762,322 | A | 8/1988 | Molitor et al. |
| 4,767,298 | A | 8/1988 | Bocchicchio et al. |
| 4,792,140 | A | 12/1988 | Yamaguchi et al. |
| 4,869,507 | A | 9/1989 | Sahm |
| 4,872,683 | A | 10/1989 | Doran et al. |
| 4,872,685 | A | 10/1989 | Sun |
| 4,883,275 | A | 11/1989 | Boone |
| 4,895,371 | A | 1/1990 | Bushner |
| 4,930,781 | A | 6/1990 | Allen |
| 5,039,098 | A | 8/1991 | Pelz |
| 5,050,879 | A | 9/1991 | Sun et al. |
| 5,135,227 | A | 8/1992 | Okumoto et al. |
| 5,186,465 | A | 2/1993 | Chorne |
| 5,205,560 | A | 4/1993 | Hoshi et al. |
| 5,213,328 | A | 5/1993 | Long et al. |
| 5,255,913 | A | 10/1993 | Tsuchida |
| 5,272,802 | A | 12/1993 | Stites, III |
| 5,294,037 | A | 3/1994 | Schmidt |
| 5,310,186 | A | 5/1994 | Karsten |
| 5,328,176 | A | 7/1994 | Lo |
| 5,346,217 | A | 9/1994 | Tsuchiya et al. |
| 5,388,827 | A | 2/1995 | Reynolds, Jr. |
| 5,429,365 | A | 7/1995 | McKeighen |
| 5,433,442 | A | 7/1995 | Walker |
| 5,435,558 | A | 7/1995 | Iriarte |
| 5,447,309 | A | 9/1995 | Vincent |
| 5,464,216 | A | 11/1995 | Hoshi et al. |
| 5,474,297 | A | 12/1995 | Levin |
| 5,482,281 | A | 1/1996 | Anderson |
| 5,484,155 | A | 1/1996 | Yamawaki et al. |
| 5,509,660 | A | 4/1996 | Elmer |
| 5,518,240 | A | 5/1996 | Igarashi |
| 5,518,243 | A | 5/1996 | Redman |
| 5,540,435 | A | 7/1996 | Kawasaki |
| 5,547,188 | A | 8/1996 | Dumontier et al. |
| 5,582,553 | A | 12/1996 | Ashcraft et al. |
| 5,586,944 | A | 12/1996 | Nagamoto et al. |
| 5,620,378 | A | 4/1997 | Fritz et al. |
| 5,624,331 | A | 4/1997 | Lo et al. |
| 5,665,014 | A | 9/1997 | Sanford et al. |
| 5,683,309 | A | 11/1997 | Reimers |
| 5,769,735 | A | 6/1998 | Hosokawa |
| 5,769,736 | A | 6/1998 | Sato |

(56) References Cited

U.S. PATENT DOCUMENTS

| | | | |
|---|---|---|---|
| 5,776,011 | A | 7/1998 | Su et al. |
| 5,785,609 | A | 7/1998 | Sheets et al. |
| 5,788,587 | A | 8/1998 | Tseng |
| 5,797,176 | A | 8/1998 | Rose et al. |
| 5,807,188 | A | 9/1998 | Serrano et al. |
| 5,816,927 | A | 10/1998 | Taylor |
| 5,842,935 | A | 12/1998 | Nelson |
| 5,871,784 | A | 2/1999 | Assink et al. |
| 5,911,638 | A | 6/1999 | Parente et al. |
| 5,916,042 | A | 6/1999 | Reimers |
| 5,935,020 | A | 8/1999 | Stites et al. |
| 5,947,840 | A | 9/1999 | Ryan |
| 5,971,867 | A | 10/1999 | Galy |
| 5,997,415 | A | 12/1999 | Wood |
| D418,885 | S | 1/2000 | Wanchena |
| 6,012,989 | A | 1/2000 | Saksun, Sr. |
| 6,033,318 | A | 3/2000 | Drajan, Jr. et al. |
| 6,059,669 | A | 5/2000 | Pearce |
| 6,074,308 | A | 6/2000 | Domas |
| 6,077,171 | A | 6/2000 | Yoneyama |
| 6,089,994 | A | 7/2000 | Sun |
| 6,102,813 | A | 8/2000 | Dill |
| 6,123,627 | A | 9/2000 | Antonious |
| 6,139,446 | A | 10/2000 | Wanchena |
| 6,149,534 | A | 11/2000 | Peters et al. |
| 6,162,133 | A | 12/2000 | Peterson |
| 6,183,377 | B1 | 2/2001 | Liang |
| 6,217,461 | B1 | 4/2001 | Galy |
| 6,248,025 | B1 | 6/2001 | Murphy et al. |
| 6,248,026 | B1 | 6/2001 | Wanchena |
| 6,254,494 | B1 | 7/2001 | Hasebe et al. |
| 6,277,032 | B1 | 8/2001 | Smith |
| 6,280,349 | B1 | 8/2001 | Cook |
| 6,296,470 | B1 | 10/2001 | Lanser et al. |
| 6,306,048 | B1 | 10/2001 | McCabe et al. |
| 6,332,848 | B1 | 12/2001 | Long et al. |
| 6,340,337 | B2 | 1/2002 | Hasebe et al. |
| 6,354,962 | B1 | 3/2002 | Galloway et al. |
| 6,354,963 | B1 | 3/2002 | Kodama et al. |
| 6,379,265 | B1 | 4/2002 | Hirakawa et al. |
| 6,409,612 | B1 | 6/2002 | Evans et al. |
| 6,422,951 | B1 | 7/2002 | Burrows |
| 6,440,009 | B1 | 8/2002 | Guibaud et al. |
| 6,442,951 | B1 | 9/2002 | Maeda et al. |
| 6,471,604 | B2 | 10/2002 | Hocknell et al. |
| 6,482,106 | B2 | 11/2002 | Saso |
| 6,514,154 | B1 | 2/2003 | Finn |
| 6,547,673 | B2 | 4/2003 | Roark |
| 6,558,271 | B1 | 5/2003 | Beach et al. |
| 6,565,425 | B1 | 5/2003 | Wuensch |
| 6,565,452 | B2 | 5/2003 | Helmstetter et al. |
| 6,572,491 | B2 | 6/2003 | Hasebe et al. |
| 6,575,845 | B2 | 6/2003 | Galloway et al. |
| 6,592,468 | B2 | 7/2003 | Vincent et al. |
| 6,592,469 | B2 | 7/2003 | Gilbert |
| 6,602,149 | B1 | 8/2003 | Jacobson |
| 6,623,378 | B2 | 9/2003 | Beach et al. |
| 6,645,086 | B1 | 11/2003 | Chen |
| 6,648,773 | B1 | 11/2003 | Evans |
| 6,695,608 | B2 | 2/2004 | Murphy et al. |
| 6,716,114 | B2 | 4/2004 | Nishio |
| 6,739,982 | B2 | 5/2004 | Murphy et al. |
| 6,739,983 | B2 | 5/2004 | Helmstetter et al. |
| 6,739,984 | B1 | 5/2004 | Ciasullo |
| 6,769,996 | B2 | 8/2004 | Tseng |
| 6,773,360 | B2 | 8/2004 | Willett et al. |
| 6,776,723 | B2 | 8/2004 | Bliss et al. |
| 6,840,755 | B1 | 1/2005 | Cook |
| 6,860,818 | B2 | 3/2005 | Mahaffey et al. |
| 6,860,823 | B2 | 3/2005 | Lee |
| 6,863,620 | B2 | 3/2005 | Tucker, Sr. |
| 6,872,152 | B2 | 3/2005 | Beach et al. |
| 6,890,267 | B2 | 5/2005 | Mahaffey et al. |
| 6,896,625 | B2 | 5/2005 | Grace |
| 6,902,497 | B2 | 6/2005 | Deshmukh et al. |
| 6,913,542 | B1 | 7/2005 | Hu et al. |
| 6,913,546 | B2 | 7/2005 | Kakiuchi |
| 6,921,343 | B2 | 7/2005 | Solheim |
| 6,926,615 | B1 | 8/2005 | Souza et al. |
| 6,929,565 | B2 | 8/2005 | Nakahara et al. |
| 6,932,875 | B2 | 8/2005 | Cheng et al. |
| 6,955,612 | B2 | 10/2005 | Lu |
| 6,988,956 | B2 | 1/2006 | Cover et al. |
| 6,991,555 | B2 | 1/2006 | Reese |
| 6,991,558 | B2 | 1/2006 | Beach et al. |
| 7,004,852 | B2 | 2/2006 | Billings |
| 7,008,332 | B2 | 3/2006 | Liou |
| 7,022,030 | B2 | 4/2006 | Best et al. |
| 7,025,692 | B2 | 4/2006 | Erickson et al. |
| 7,041,005 | B2 | 5/2006 | Beach et al. |
| 7,063,629 | B2 | 6/2006 | Nakahara et al. |
| 7,070,517 | B2 | 7/2006 | Cackett et al. |
| 7,094,159 | B2 | 8/2006 | Takeda |
| 7,108,609 | B2 | 9/2006 | Stites et al. |
| 7,128,664 | B2 | 10/2006 | Onoda et al. |
| 7,140,974 | B2 | 11/2006 | Chao et al. |
| 7,147,573 | B2 | 12/2006 | DiMarco |
| 7,156,752 | B1 | 1/2007 | Bennett |
| 7,160,040 | B2 | 1/2007 | Matsushima |
| 7,163,468 | B2 | 1/2007 | Gibbs et al. |
| 7,166,038 | B2 | 1/2007 | Williams et al. |
| 7,166,040 | B2 | 1/2007 | Hoffman et al. |
| 7,169,060 | B2 | 1/2007 | Stevens et al. |
| 7,175,541 | B2 | 2/2007 | Lo |
| 7,186,190 | B1 | 3/2007 | Beach et al. |
| 7,204,768 | B2 | 4/2007 | Nakahara et al. |
| 7,217,199 | B2 | 5/2007 | Nakahara et al. |
| 7,244,188 | B2 | 7/2007 | Best |
| 7,252,599 | B2 | 8/2007 | Hasegawa |
| 7,258,624 | B2 | 8/2007 | Kobayashi |
| 7,258,625 | B2 | 8/2007 | Kawaguchi et al. |
| 7,281,993 | B2 | 10/2007 | Oyama |
| 7,297,072 | B2 | 11/2007 | Meyer et al. |
| 7,303,487 | B2 | 12/2007 | Kumamoto |
| 7,338,390 | B2 | 3/2008 | Lindsay |
| D567,888 | S | 4/2008 | Soracco |
| 7,371,191 | B2 | 5/2008 | Sugimoto |
| 7,377,860 | B2 | 5/2008 | Breier et al. |
| 7,419,441 | B2 | 9/2008 | Hoffman et al. |
| 7,491,131 | B2 | 2/2009 | Vinton |
| 7,524,149 | B2 | 4/2009 | Heule et al. |
| 7,524,249 | B2 | 4/2009 | Breier et al. |
| 7,530,901 | B2 | 5/2009 | Imamoto et al. |
| 7,549,933 | B2 | 6/2009 | Kumamoto |
| 7,566,279 | B2 | 7/2009 | Nakashima |
| 7,625,298 | B2 | 12/2009 | Bennett |
| 7,632,195 | B2 | 12/2009 | Jorgensen |
| 7,658,686 | B2 | 2/2010 | Soracco |
| 7,753,809 | B2 | 7/2010 | Cackett et al. |
| 7,758,451 | B2 | 7/2010 | Liang et al. |
| 7,771,290 | B2 | 8/2010 | Bezilla et al. |
| 7,789,766 | B2 | 9/2010 | Morris et al. |
| 7,803,065 | B2 | 9/2010 | Breier et al. |
| 7,806,782 | B2 | 10/2010 | Stites et al. |
| 7,819,754 | B2 | 10/2010 | Evans et al. |
| 7,854,665 | B2 | 12/2010 | Dewhurst et al. |
| 7,938,740 | B2 | 5/2011 | Breier et al. |
| 7,959,522 | B2 | 6/2011 | North, III et al. |
| 7,980,964 | B2 | 7/2011 | Soracco |
| 8,007,371 | B2 | 8/2011 | Breier et al. |
| 8,033,930 | B2 | 10/2011 | Tavares et al. |
| 8,038,545 | B2 | 10/2011 | Soracco |
| 8,057,323 | B2 | 11/2011 | Liang et al. |
| 8,062,151 | B2 | 11/2011 | Boyd et al. |
| 8,133,128 | B2 | 3/2012 | Boyd et al. |
| 8,133,129 | B2 | 3/2012 | Boyd et al. |
| 8,162,776 | B2 | 4/2012 | Boyd et al. |
| 8,206,243 | B2 | 6/2012 | Stites |
| 8,303,433 | B2 | 11/2012 | Roach et al. |
| 8,337,319 | B2 | 12/2012 | Sargent et al. |
| 8,376,873 | B2 | 2/2013 | Golden et al. |
| 8,382,607 | B2 | 2/2013 | Burnett et al. |
| 8,435,135 | B2 | 5/2013 | Stites et al. |
| 8,523,705 | B2 | 9/2013 | Breier et al. |

(56) References Cited

U.S. PATENT DOCUMENTS

| | | | | |
|---|---|---|---|---|
| 8,585,514 | B2 | 11/2013 | Boyd et al. | |
| 8,834,294 | B1 | 9/2014 | Seluga et al. | |
| 9,067,110 | B1 | 6/2015 | Seluga et al. | |
| 9,199,143 | B1 | 12/2015 | Parsons et al. | |
| 9,393,471 | B2 * | 7/2016 | Beno | A63B 53/06 |
| 9,421,438 | B2 * | 8/2016 | Beno | A63B 60/42 |
| 9,440,123 | B2 * | 9/2016 | Beno | A63B 53/0475 |
| 2001/0001302 | A1 | 5/2001 | Murphy et al. | |
| 2001/0049310 | A1 | 12/2001 | Cheng et al. | |
| 2002/0045490 | A1 | 4/2002 | Ezawa et al. | |
| 2002/0049093 | A1 | 4/2002 | Reyes et al. | |
| 2002/0077195 | A1 | 6/2002 | Carr et al. | |
| 2002/0137576 | A1 | 9/2002 | Dammen | |
| 2002/0160858 | A1 | 10/2002 | Lee | |
| 2003/0045371 | A1 | 3/2003 | Wood et al. | |
| 2003/0100381 | A1 | 5/2003 | Murphy et al. | |
| 2003/0130059 | A1 | 7/2003 | Billings | |
| 2003/0134690 | A1 | 7/2003 | Chen | |
| 2003/0134693 | A1 | 7/2003 | Nakahara et al. | |
| 2003/0144078 | A1 | 7/2003 | Setokawa et al. | |
| 2003/0162608 | A1 | 8/2003 | Chen | |
| 2004/0116207 | A1 | 6/2004 | De Shiell et al. | |
| 2004/0116208 | A1 | 6/2004 | De Shiell et al. | |
| 2004/0138002 | A1 | 7/2004 | Murray | |
| 2004/0176177 | A1 | 9/2004 | Mahaffey et al. | |
| 2004/0192468 | A1 | 9/2004 | Onoda et al. | |
| 2004/0224790 | A1 | 11/2004 | Lu | |
| 2004/0242343 | A1 | 12/2004 | Chao et al. | |
| 2004/0254030 | A1 | 12/2004 | Nishitani et al. | |
| 2005/0026723 | A1 | 2/2005 | Kumamoto | |
| 2005/0090330 | A1 | 4/2005 | Kumamoto | |
| 2005/0101408 | A1 | 5/2005 | Sanchez et al. | |
| 2005/0119070 | A1 | 6/2005 | Kumamoto | |
| 2005/0159243 | A1 | 7/2005 | Chuang | |
| 2005/0170907 | A1 | 8/2005 | Saso | |
| 2005/0215354 | A1 | 9/2005 | Kumamoto | |
| 2005/0272527 | A1 | 12/2005 | Sugimoto | |
| 2006/0014592 | A1 | 1/2006 | Sugimoto | |
| 2006/0052177 | A1 | 3/2006 | Nakahara et al. | |
| 2006/0052181 | A1 | 3/2006 | Serrano et al. | |
| 2006/0084525 | A1 | 4/2006 | Imamoto et al. | |
| 2006/0100032 | A1 | 5/2006 | Imamoto et al. | |
| 2006/0105855 | A1 | 5/2006 | Cackett et al. | |
| 2006/0116218 | A1 | 6/2006 | Burnett et al. | |
| 2006/0240907 | A1 | 10/2006 | Latiri | |
| 2007/0054751 | A1 | 3/2007 | Breier et al. | |
| 2007/0060414 | A1 | 3/2007 | Breier et al. | |
| 2007/0249432 | A1 | 10/2007 | Wu | |
| 2007/0265109 | A1 | 11/2007 | Elmer | |
| 2008/0058117 | A1 | 3/2008 | Roach | |
| 2008/0070721 | A1 | 3/2008 | Chen et al. | |
| 2008/0102975 | A1 | 5/2008 | Chen | |
| 2008/0102978 | A1 | 5/2008 | Burnett et al. | |
| 2008/0227564 | A1 | 9/2008 | Breier et al. | |
| 2008/0230948 | A1 | 9/2008 | Salvador et al. | |
| 2008/0242445 | A1 | 10/2008 | Mergy et al. | |
| 2008/0261715 | A1 | 10/2008 | Carter | |
| 2008/0268980 | A1 | 10/2008 | Breier et al. | |
| 2008/0293510 | A1 | 11/2008 | Yamamoto | |
| 2009/0105010 | A1 | 4/2009 | De La Cruz et al. | |
| 2009/0118034 | A1 | 5/2009 | Yokota | |
| 2009/0186717 | A1 | 7/2009 | Stites et al. | |
| 2009/0203465 | A1 | 8/2009 | Stites et al. | |
| 2010/0041490 | A1 | 2/2010 | Boyd et al. | |
| 2010/0041493 | A1 | 2/2010 | Clausen et al. | |
| 2010/0041495 | A1 | 2/2010 | North, III et al. | |
| 2010/0105499 | A1 | 4/2010 | Roach et al. | |
| 2010/0130304 | A1 | 5/2010 | Soracco | |
| 2010/0130305 | A1 | 5/2010 | Soracco | |
| 2010/0160091 | A1 | 6/2010 | Boyd et al. | |
| 2010/0261543 | A1 | 10/2010 | Breier et al. | |
| 2010/0331103 | A1 | 12/2010 | Takahashi et al. | |
| 2011/0021282 | A1 | 1/2011 | Sander | |
| 2011/0045921 | A1 | 2/2011 | Evans | |
| 2011/0053706 | A1 | 3/2011 | Breier et al. | |
| 2011/0081986 | A1 | 4/2011 | Stites | |
| 2011/0098128 | A1 | 4/2011 | Clausen et al. | |
| 2011/0111885 | A1 | 5/2011 | Golden et al. | |
| 2011/0159986 | A1 | 6/2011 | Chao et al. | |
| 2011/0207547 | A1 | 8/2011 | Sander et al. | |
| 2011/0312437 | A1 | 12/2011 | Sargent et al. | |
| 2012/0064991 | A1 | 3/2012 | Evans | |
| 2012/0129621 | A1 | 5/2012 | Boyd et al. | |
| 2013/0178306 | A1 | 7/2013 | Beno et al. | |

FOREIGN PATENT DOCUMENTS

| | | | |
|---|---|---|---|
| JP | 2000-024149 | A | 1/2000 |
| JP | 2002-336389 | A | 11/2002 |
| JP | 2003-093554 | A | 4/2003 |
| JP | 2003-310808 | A | 11/2003 |
| JP | 2004-121744 | A | 4/2004 |
| JP | 2004-159680 | A | 6/2004 |
| JP | 2004-337327 | A | 12/2004 |
| JP | 2006-25929 | | 2/2006 |
| JP | 2006-025929 | A | 2/2006 |
| JP | 2006-130065 | A | 5/2006 |
| WO | 2004/052472 | A1 | 6/2004 |
| WO | 2007/101350 | A1 | 9/2007 |

OTHER PUBLICATIONS

Jackson, J., The Modern Guide to Golf Clubmaking, p. 239, Dynacraft, Ohio (3 pages).

Japanese Office Action for JP Appl. 2007-311561 of Jun. 30, 2010 (7 pages).

Japanese Office Action for JP Appl. 2007-085624 of Jul. 7, 2010 (6 pages).

Non-Final Office Action dated May 20, 2009 for U.S. Appl. No. 11/110,733 (13 pages).

Final Office Action dated Oct. 1, 2008 for U.S. Appl. No. 11/110,733 (15 pages).

Non-Final Office Action dated Dec. 31, 2007 for U.S. Appl. No. 11/110,733 (11 pages).

Non-Final Office Action dated Jun. 5, 2007 for U.S. Appl. No. 11/110,733 (9 pages).

Notice of Allowance dated Dec. 31, 2008 for U.S. Appl. No. 11/363,098 (6 pages).

Non-Final Office Action dated Jun. 12, 2008 for U.S. Appl. No. 11/363,098 (11 pages).

Non-Final Office Action dated Oct. 27, 2009 for U.S. Appl. No. 11/591,588 (14 pages).

Non-Final Office Action dated Dec. 7, 2009 for U.S. Appl. No. 11/898,756 (10 pages).

Non-Final Office Action dated Nov. 13, 2009 for U.S. Appl. No. 11/600,081 (14 pages).

Notice of Allowance dated Sep. 28, 2009 for U.S. Appl. No. 11/110,733 (6 pages).

Jackson, Jeff, The Modern Guide to Golf Clubmaking, Ohio: Dynacraft Golf Products, Inc. copyright 1994, p. 239.

Japanese Office Action for Application No. 2007-311561, dated Jun. 30, 2010, in 7 pages.

Japanese Office Action titled Pretrial Reexamination Report for Japanese Application No. 2007-085624, (Appeal Trial No. 2010-009497), dated Jul. 7, 2010, in 6 pages.

Notice of Allowance dated Sep. 28, 2009 of corresponding U.S. Appl. No. 11/110,733.

Non-Final Office Action dated May 20, 2009 of corresponding U.S. Appl. No. 11/110,733.

Final Office Action dated Oct. 1, 2008 of corresponding U.S. Appl. No. 11/110,733.

Non-Final Office Action dated Dec. 31, 2007 of corresponding U.S. Appl. No. 11/110,733.

Non-Final Office Action dated Jun. 5, 2007 of corresponding U.S. Appl. No. 11/110,733.

Notice of Allowance dated Dec. 31, 2008 of corresponding U.S. Appl. No. 11/363,098.

Non-Final Office Action dated Jun. 12, 2008 of corresponding U.S. Appl. No. 11/363,098.

(56) References Cited

OTHER PUBLICATIONS

Non-Final Office Action dated Oct. 27, 2009 of corresponding U.S. Appl. No. 111591,588.
Non-Final Office Action dated Dec. 7, 2009 of corresponding U.S. Appl. No. 11/898,756.
Non-Final Office Action dated Nov. 13, 2009 of corresponding U.S. Appl. No. 11/600,081.
European Search Report for European Application No. 10013627.4-2318, dated Mar. 11, 2011, in 8 pages.

* cited by examiner

Moveable Weight - 19 gms, Crown Weight 19.5 gms., 209 gm. Head

| | MOI | CG_x | CG_y | CG_na |
|---|---|---|---|---|
| Heel | 4545 | 4.5 | 31 | 1.7 |
| Center | 4241 | 0.3 | 31 | 0.5 |
| Toe | 4466 | -2.7 | 31 | 1.3 |

GOLF CLUB HEAD WITH ACCESSIBLE INTERIOR

CROSS-REFERENCE TO RELATED APPLICATIONS

This application is a continuation of U.S. patent application Ser. No. 14/258,694, filed Apr. 22, 2014, which is a continuation-in-part of U.S. patent application Ser. No. 14/150,035, filed Jan. 8, 2014 (now U.S. Pat. No. 9,393,471), which is a continuation-in-part of U.S. patent application Ser. No. 13/545,329, filed Jul. 10, 2012, which is a continuation-in-part of U.S. patent application Ser. No. 13/185,324, filed Jul. 18, 2011, which is a continuation of U.S. patent application Ser. No. 12/696,468, filed Jan. 29, 2010 (now U.S. Pat. No. 7,980,964), which is a continuation of U.S. patent application Ser. No. 11/110,733, filed Apr. 21, 2005 (now U.S. Pat. No. 7,658,686).

U.S. patent application Ser. No. 13/545,329, filed Jul. 10, 2012, is also a continuation-in-part of U.S. patent application Ser. No. 13/539,958, filed Jul. 2, 2012, which claims the benefit of and priority to U.S. Provisional Application No. 61/513,509, filed Jul. 29, 2011.

U.S. patent application Ser. No. 13/545,329, filed Jul. 10, 2012, is also a continuation-in-part of U.S. patent application Ser. No. 13/407,087, filed Feb. 28, 2012, which is a continuation-in-part of U.S. patent application Ser. No. 12/643,154, filed Dec. 21, 2009 (now U.S. Pat. No. 8,147,354).

The contents of each of the above listed applications are hereby incorporated by reference herein in their entireties.

FIELD OF THE INVENTION

The invention relates to a golf club head with an accessible interior.

BACKGROUND

Golfers need golf clubs that can be used to hit the ball the right distance in the intended direction and enjoy the game more when the golf clubs have been customized and personalized to match their abilities and preferences. Over the last ten years, golf club manufacturers have made many attempts to offer golfers the ability to adjust and customize their golf clubs. Some attempts include adjustable weight systems, adjustable loft or lie angles, means to attenuate sound, and personalization. Those clubs are fraught with problems because the adjustment mechanisms interfere with aerodynamics, collect dirt and grime, have small parts that break when they hit the ground during use, and are difficult to use. Some attempts have been made to put weights inside of golf clubs. For example, U.S. Pub. 2008/0261715 to Carter shows a golf club head with tracks and weights. U.S. Pat. No. 8,206,243 to Stites reports a moveable weight member in a golf club head. U.S. Pub. 2013/0260913 to Beach shows a club head with a track with a weight. U.S. Pub. 2013/0296070 to Stites shows a club head with face-aft weight slot in the sole. Unfortunately, some weight systems break during use. External adjustment mechanisms are complicated to use, fragile, and adversely affect inertial properties.

SUMMARY

The invention provides a golf club head that provides access to an interior of the club head. The interior may include an adjustment or customization mechanism disposed therein. When the club is played, no part of any internal mechanisms are directly accessible or exposed to an exterior of the club. The club head may include a panel that opens or is removable, or the club head may be disassembled to provide access to the interior. The interior may be customizable or may include a weight adjustment system that includes at least one mechanism by which a mass distribution of the golf club head can be changed. For example, a golfer can move weight to a heel or a toe to correct a hook or a slice, or the golfer could increase or decrease a golf club head's moment of inertia about a vertical axis (e.g., moving mass out towards the heel and toe, moving mass heel-ward, or both may tend to increase MOI about a vertical axis. Since mass distribution of a club head can be adjusted, a golfer can have a golf club that is personalized to their playing style. Since the weighting system is internal, pieces of the weighting system are not subject to ground impact or environmental insult during play. Thus a golf club of the present invention is durable and can be personalized and will aid a golfer in hitting a golf ball a good distance in an intended direction. Further, the internal accessibility allows greater ease manufacture of the club head, thus increases yield rates. Additionally, the accessible interior allows greater tolerances to be achieved, and further improves the ability to apply a premium finish on the exterior of the club head.

In certain aspects, the invention provides a golf club head that includes a club head body comprising a sole, a crown, a face, and a hosel, and in which an interior of the club head is accessible for adjustment by means of an opening mechanism. In some embodiments, the opening mechanism, when open, provides an aperture giving access into an interior volume of the club head body that is enclosed when the opening mechanism is closed, wherein the aperture has an open area of at least 3 $cm^2$.

The opening mechanism may include a portion of the club head that is configured to be removed from, and re-attached to, the club head body. In some embodiments, the removable portion attaches to the club head body via at least one mechanical fastener such as, for example, a screw, a bolt, a flared tab, or a hook-and-loop fastener.

Alternatively or additionally, the opening mechanism may include an openable portion of the club head that is configured to be opened without being removed from the club head body. In some embodiments, the openable portion is attached to the club head body via a hinge.

In certain embodiments, the club head includes an adjustment mechanism within the club head body for adjusting a property of the club head.

In certain aspects, the invention provides a golf club head with a club head body having a sole, crown, face, and hosel and a mass adjustment mechanism inside of the club head body configured for adjusting a mass distribution of the club head body. The club head may be a hollow, wood-type golf club head and the club head body defines an enclosed interior volume. The mass adjustment mechanism may be disposed within the enclosed interior volume.

In some embodiments, the club head body includes a first body member comprising a portion of the sole, the hosel, and the face, the first body member having an attachment perimeter defining an opening as well as a second body member coupled to the attachment perimeter to enclose the opening. In certain embodiments, the mass adjustment mechanism comprises a weight mount point. The weight mount point may include a threaded socket.

In some embodiments, the mass adjustment mechanism includes a mounting track disposed on an inner surface of the club head body and at least one weight member mounted on the mounting track. Preferably, the at least one weight member is repositionable to any arbitrary position along the mounting track. The mounting track may be disposed on the inner surface of the sole, extending substantially in a heel-toe direction. The mounting track may define a substantially straight line from the heel to the toe that is substantially parallel to the face. In some embodiments, the at least one weight member can be moved along the track by removing the second body member from the club head body to access the at least one weight member.

In certain embodiments, the mass adjustment mechanism comprises at least one repositionable weight member having a surface configured to mount to an internal surface of the club head via a peg-and-hole press-fit system. The surface may include a plurality of holes configured to receive a corresponding plurality of pegs on the internal surface of the club head. In some embodiments, the surface comprises a plurality of pegs configured for insertion into a corresponding plurality of holes on the internal surface of the club head.

In certain embodiments, the mass adjustment mechanism comprises one or a plurality of weight mount points that include threaded sockets inside of a hollow, wood-type golf club head that defines an enclosed interior volume. The club head preferably includes one or more repositionable weights configured for threaded attachment to one of the plurality of weight mount points.

In some embodiments, the weight mount point uses a slot, and the club head includes a detachable weight member with a tab configured for insertion into the slot, such that rotating the tab inside of the slot fastens the weight member to the mount point. Such a repositionable weight may make a snap-fit attachment to the weight mount point.

In certain embodiments, the mass adjustment mechanism uses a subtractive system. The subtractive mass adjustment mechanism may operate via weight pads configured to be machined away on an inside surface of the club head.

In some embodiments, a mass adjustment mechanism may use one or more mount points that define pockets or cages each configured to receive a weight member. The weight member may snap into the pocket or cage and may include a button configured to be pressed to release the weight member from the mount point.

In certain aspects, the invention provides a golf club head that includes an internal weighting system that includes an internal track and optionally includes one or more internal weight-mount points. The internal track allows a weight member to be repositioned at any arbitrary position along the track and also provides the necessary strength to prevent shear stress failures. The weight member may be slid along the track and fixed into place at a desired position. Preferably, the internal track extends from a heels side of the club head to a toe side of the club head and may extend across an inside surface of the sole. The invention includes the insight that a golf club experiences critically high instantaneous shear stresses upon impact with a golf ball and that those stresses may cause breakage in prior art club heads. An internal track of the present invention is oriented opposed to a primary vector of instantaneous shear stress and thus absorbs and dissipates that stress at sub-critical magnitudes during impact with a golf ball. Since the internal track system opposes a primary vector of instantaneous shear stress and dissipates that stress during play, shear stress does not reach critically high instantaneous values that cause breakage of the weight systems.

Aspects of the invention provide a club head that gives access to an interior of the club head. The club head may include a panel that opens or is removable, or the club head may be designed and configured for disassembly and reassembly to provide access to the interior. Access to the interior of the head may facilitate weight adjustment, sound adjustment, personalization, or other customization or adjustment schema. In one embodiment, a club head includes a rib member attached with various mount points such as weld beads and the removal of certain mount points or portions of the rib member can be done to alter the sound of the club head. In another embodiment, lead tape or foam pieces can be adhered to the interior of the club head to adjust weight, mitigate vibration and/or attenuate sound. In certain embodiments, the club head includes a sound tuning member that could be repositioned internally (e.g., into certain quadrants) to address sound attenuation. In some embodiments, access to the interior of the club head opens up the interior of the club head as a medium for communication through the inclusion of information such as printing, indicia, markings or colorings, etc. A golfer may personalize their club within the interior. For example, personalization could include someone adding a motivational slogan or their initials to identify their club.

DETAILED DESCRIPTION

Embodiments of the invention provide a golf club head that includes a club head body comprising a sole, a crown, a face, and a hosel, and in which an interior of the club head is accessible for adjustment. The club head is preferably a hollow, wood-type club head that is accessible by means of an opening mechanism.

Figure 1:
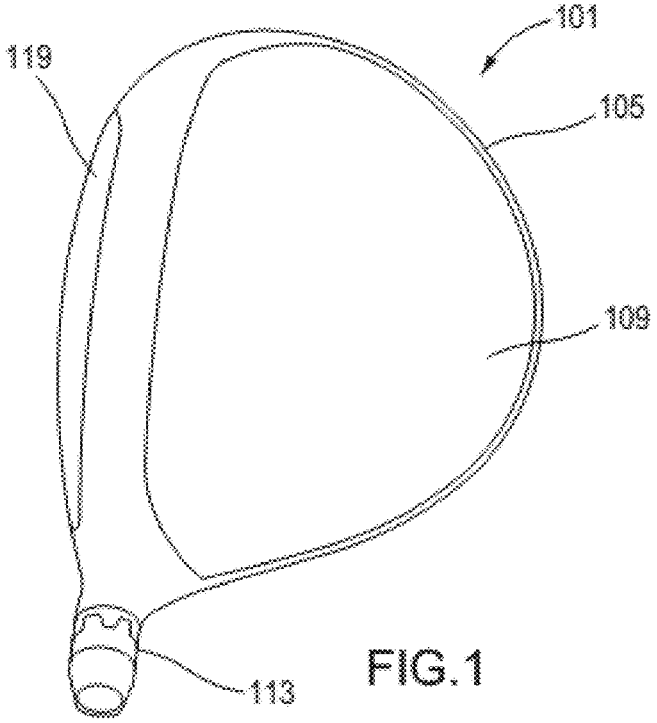
FIG. 1 shows a club head of the present invention.

FIG. 1 shows a club head 101 of the present invention. Club head 101 includes a club head body 105 with a sole, crown, face 119, and hosel 113 and has an accessible interior via openable second body member 109. In the depicted embodiment, second body member 109 has an area greater than about 3 $cm^2$. This means that the opening mechanism, when open, provides an aperture giving access into an interior volume of the club head body that is enclosed when the opening mechanism is closed, wherein the aperture has an open area of at least 3 $cm^2$.

In certain embodiments, openable second body member 109 is provided as a removable component. That is, the club head body comprises a first body member 105 comprising a portion of the sole, the hosel, and the face, the first body member having an attachment perimeter defining an opening and a second body member 109 coupled to the attachment perimeter to enclose the opening. Any suitable portion of club head 101 may be removable. For example, removable component 109 may be a panel of the sole, the entire sole, an aft body, a crown panel, or other. As shown in FIG. 1, removable panel 109 is a crown portion of club head 101. Club head 101 includes a mechanism to fasten removable panel 109 in place.

In certain embodiments, club head 101 also includes a mass adjustment mechanism inside of the club head body configured for adjusting a mass distribution of the club head body. Club head 101 may be any type of club head such as any wood-type or hybrid-type club head, i.e., a hollow, wood-type golf club head and the club head body defines an enclosed interior volume. Preferably, the mass adjustment mechanism is disposed within the enclosed interior volume. Generally, club head 101 will include a club head body 105 defining an overall shape of the head. Club head 101 will generally include a ball-striking face 119 and a hosel 113.

Figure 2:
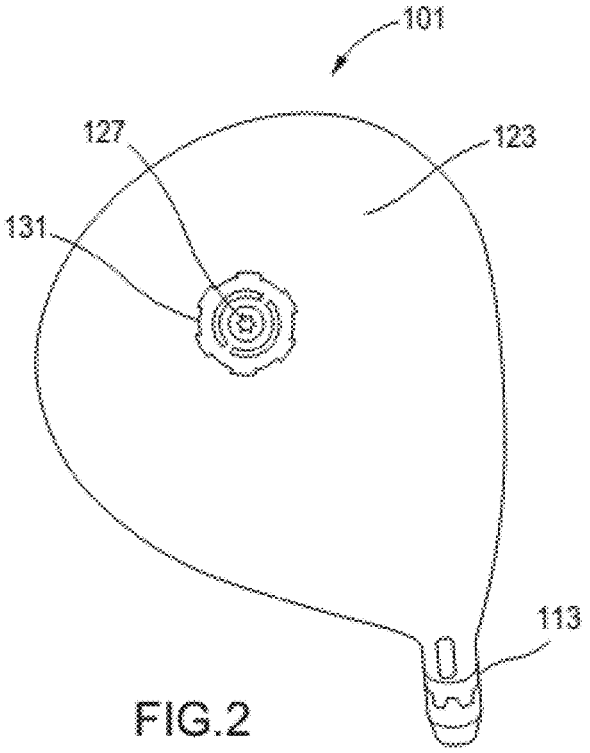
FIG. 2 shows a sole of a club head according to some embodiments.

FIG. 2 shows a sole 123 of club head 101 according to some embodiments. Visible on sole 123 is fastening mechanism 131 having a mechanical fastener fastened therein, such as, for example, a screw 127. Screw 127 (or any other suitable fastener such as a barbed post, a cotter pin, or other binder) is accessible from an exterior of club head 101. When screw 127 is in place, removable component 109 is held in place and club head 101 can be used in playing golf. A golfer can use a tool, such as a specialty tool with a custom tip, to unfasten screw 127 via a tool interface surface, such as a shaped recessed tool port. A golfer can unscrew screw 127 and release it, thereby releasing removable component 109.

Figure 3:
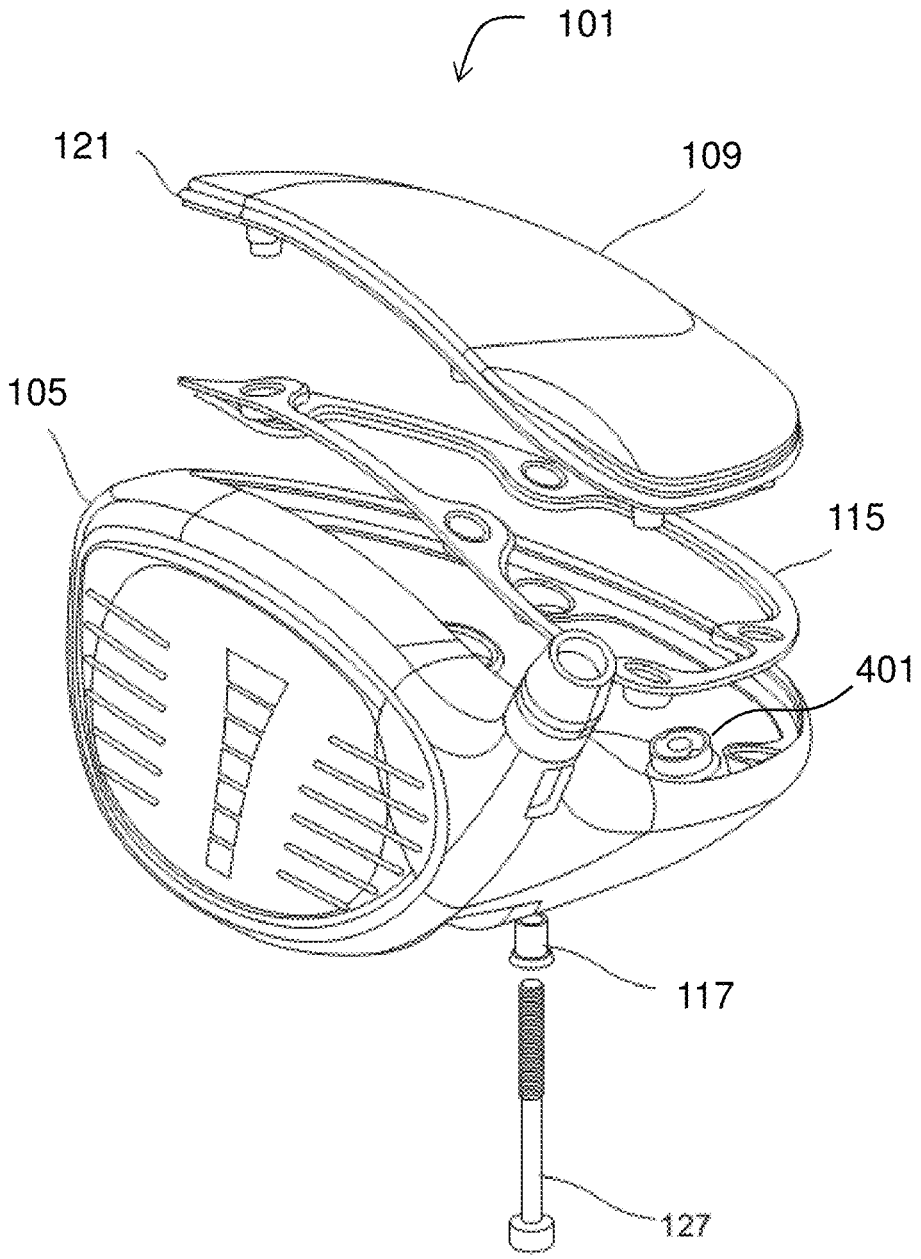
FIG. 3 shows an exploded view of a golf club head according to some embodiments.

FIG. 3 shows an exploded view of a golf club head 101 according to some embodiments with an openable component 109. As depicted in FIG. 3, openable component 109 provides an opening mechanism that includes a portion of the club head that is configured to be removed from, and re-attached to, the club head body. In some embodiments, the removable portion attaches to the club head body via at least one mechanical fastener such as, for example, a screw 127. It should be noted that the mechanical fastener for securing the removable component 109 in place may include a variety of different types of fasteners and is not limited to a screw. For example, in other embodiments, the mechanical fastener may include, but is not limited to, a bolt, a flared tab, a hook-and-loop fastener, a rivet, a semi-permanent adhesive, an interference fit fastener, a cam lock fastener, a spring-loaded fastener, and other suitable fasteners.

Additionally, removable component 109 may sit on gasket 115 which may be glued to the club head body 105 (e.g., titanium). Assembly screw 127 is seated within club head body 105 through the use of a shoulder member 117 (e.g., Ti, Al, PTFE, carbon fiber, etc.). Screw 127 may be held in the place through a rubber washer or similar mechanism. O-ring 121 extends around a perimeter of removable crown 109. As illustrated by FIG. 3, aspects of the invention provide a club head that gives access to an interior of the club head. The club head may include a panel that opens or is removable, or the club head may be designed and configured for disassembly and reassembly to provide access to the interior. Access to the interior of the head may facilitate weight adjustment, sound adjustment, personalization, or other customization or adjustment schema. Club head 101 includes a mass adjustment mechanism that here includes a weight mount point 401 on an inside surface of the club head.

In one embodiment, a club head includes a rib member attached with various mount points such as weld beads and the removal of certain mount points or portions of the rib member can be done to alter the sound of the club head. For example, a metal rib may extend across at least part of an inside surface of a sole of the club head. The rib may be welded at a plurality of points, aka weld beads (e.g., there may be 3, or 5, or 7, or 50, or any number, of weld points). A golfer (or a consultant in a pro shop) may snap off some of the weld beads to tune a sound of the rib according to the golfer. A golfer may perform best if the sound is tailored to their particular, personal hearing range or sensitivities. In certain embodiments, the club head includes a sound tuning member such as a rib that can be repositioned internally for sound tuning. To give one example, a sound tuning member can attach via the system discussed with respect to FIGS. 12 & 13 below. Moreover, an inside surface of the club head can include markings to guide the location of the sound tuning member to aid a golfer in obtaining a desired sound quality.

In some embodiments, access to the interior of the club head opens up the interior of the club head as a medium for communication through the inclusion of information such as printing, indicia, markings or colorings, etc. A golfer may personalize their club within the interior. For example, personalization could include someone adding a motivational slogan or their initials to identify their club. An inside surface of the club head can be personalized by any suitable method such as painting, engraving, decals, a slot for holding a printed card, etc.

In some embodiments, access to the interior of the club head further allows insertion and/or removal of an electronic device within the interior of the club head. The electronic device may be configured to capture a variety of information related to the club and club performance, such as, for example, club type and club settings, impact of ball with the face of the club, angle of impact, rotation of club in downward and upward swing, etc. In certain embodiments, the electronic device may include a battery, solenoid, sensors (motion sensor, accelerometers, gyroscopes, magnetometers, switches, or other electric or mechanical device, or a combination thereof). Accordingly, the device may be configured to detect or measure motion of the club in any one of, or any combination of, numerous modes including acceleration, translation motions, vibration, shock, tilt, and rotation. The device may also include an RFID tag or other device. An RFID tag can be used to uniquely identify the club (or the player, golf course, club set, manufacturer, etc.) to an electronic device and thus to support information gathering for a game improvement program. Exemplary systems and devices for collecting and analyzing data are discussed in GOLF CLUB WITH ELECTRONIC DEVICE, U.S. patent application Ser. No. 14/102,866 to Tim Beno, et al., filed Dec. 11, 2013, and GOLF CLUB GRIP WITH DEVICE HOUSING, U.S. patent application Ser. No. 13/946,543 to Tim Beno, et al., filed Jul. 19, 2013, the contents of each of which are hereby incorporated by reference in their entirety.

The electronic device can be configured to communicate with other electronic devices. For example, the electronic device can include wireless communication means such as a 3G or 4G cell antenna, Bluetooth, RFID tag, or a Wi-Fi card. A chip on device can communicate, directly or via a network, with another electronic device that offers some functionality to a golfer. For example, device can communicate with a smartphone, a tablet computer, a laptop, or any other computing device. Data collected by device can be transmitted to another electronic device for further storage or processing.

In some embodiments, the invention provides software for processing data captured by device. Software can be an app that a golfer downloads onto a device, an application that a golfer installs onto a computing device, one or more programs that run on a web server accessible, for example, via a web page, or any combination thereof. By installing the golf-data analyzing software or running it in the memory of a computer device, including a memory coupled to processor, the processor can execute one or more programs to analyze data related to the playing of golf. Analysis includes displaying, comparing, and calculating (e.g., taking an average or interpolating a trend).

A game improvement program can be administered using electronic devices as well as computer systems and computer program-based analytical tools. Thus, using devices and methods of the invention, a golfer can gather information during their game and use that information to analyze their performance or to enhance their enjoyment of the game by, for example, competing electronically with their friends, comparing their performance to a pro's, or documenting their performance over time. Exemplary systems and methods for improving performance to enhance enjoyment of golf by data collection are discussed in Systems and Methods for Communication Sports-Related Information, U.S. Pub. 2012/0316843, Method and System for Athletic Motion Analysis and Instruction, U.S. Pub. 2007/0270214, and Method and System for Athletic Motion Analysis and Instruction, U.S. Pub. 2006/0166737, the contents of each of which are hereby incorporated by reference in their entirety.

Figure 4:
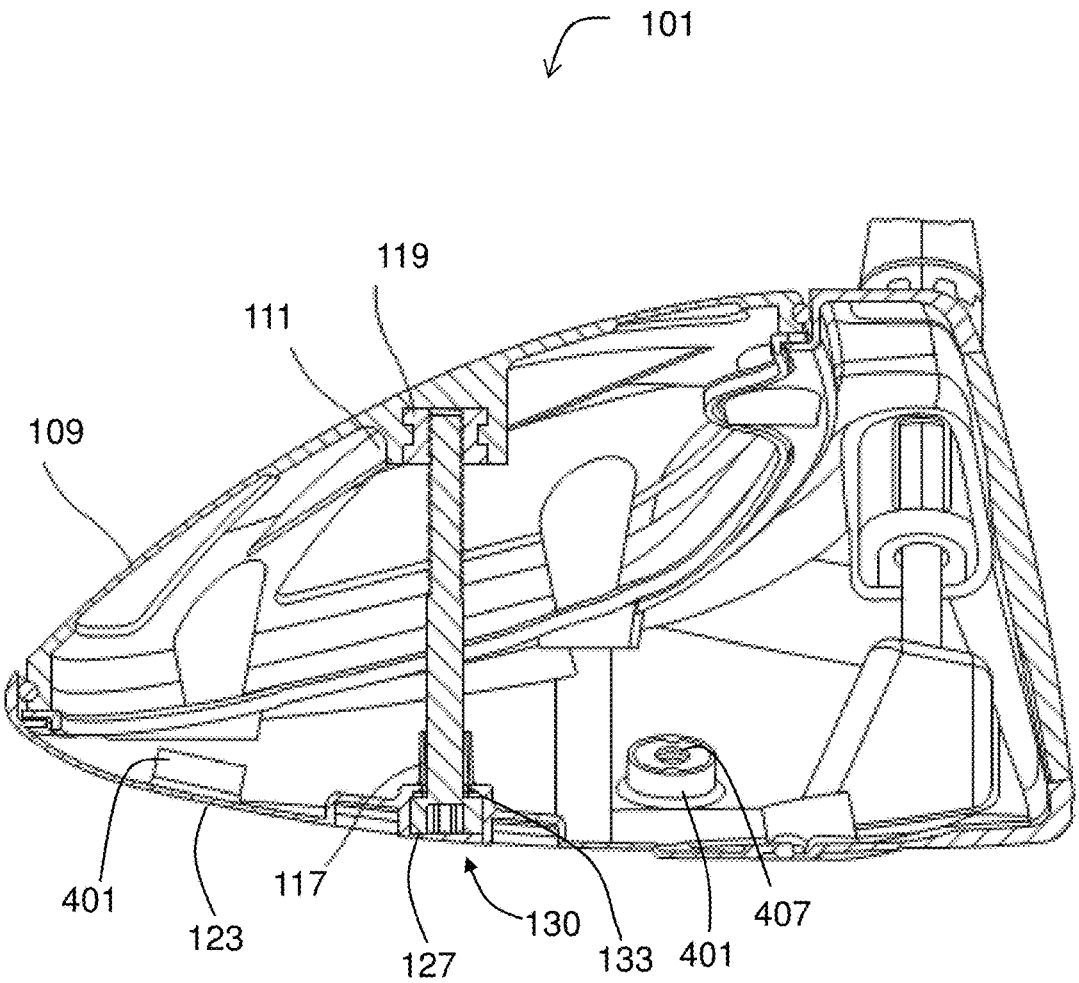
FIG. 4 shows a cutaway view through a club head.

FIG. 4 shows a cutaway view through club head 101. As shown in FIG. 4, the mass adjustment mechanism includes a plurality of weight mount points 401. In the illustrated embodiment, at least one weight mount point 401 includes a threaded socket 407 configured to receive a weight member, as described in greater detail herein.

It can be seen that center post 111 extending down from removable component 109 is fitted with a threaded insert 119. This may be, for example, an aluminum insert co-molded into crown 109. As shown, screw 127 extends through a crown fastener mount point 130 and through the sole 123, extending into the interior volume of the club head. Crown fastener mount point 130 may generally define a recessed portion on the sole 123 and may include a bore 133 shaped and/or sized to receive a portion of the screw 127 there through and into the interior volume of the club head. Screw 127 extends from shoulder 117 to threaded insert 119 to fasten removable component 109 into place. Accordingly, in the illustrated embodiment, the screw 127 extends into and through an interior volume of the club head, essentially from the sole 123 to the removable component 109 forming a portion of the crown. As previously described, screw 127 is accessible from an exterior of club head, such that a golfer has access to the screw 127 and can unfasten screw 127 and release it, thereby releasing removable component 109 for access to the interior of the club head.

Figure 5:
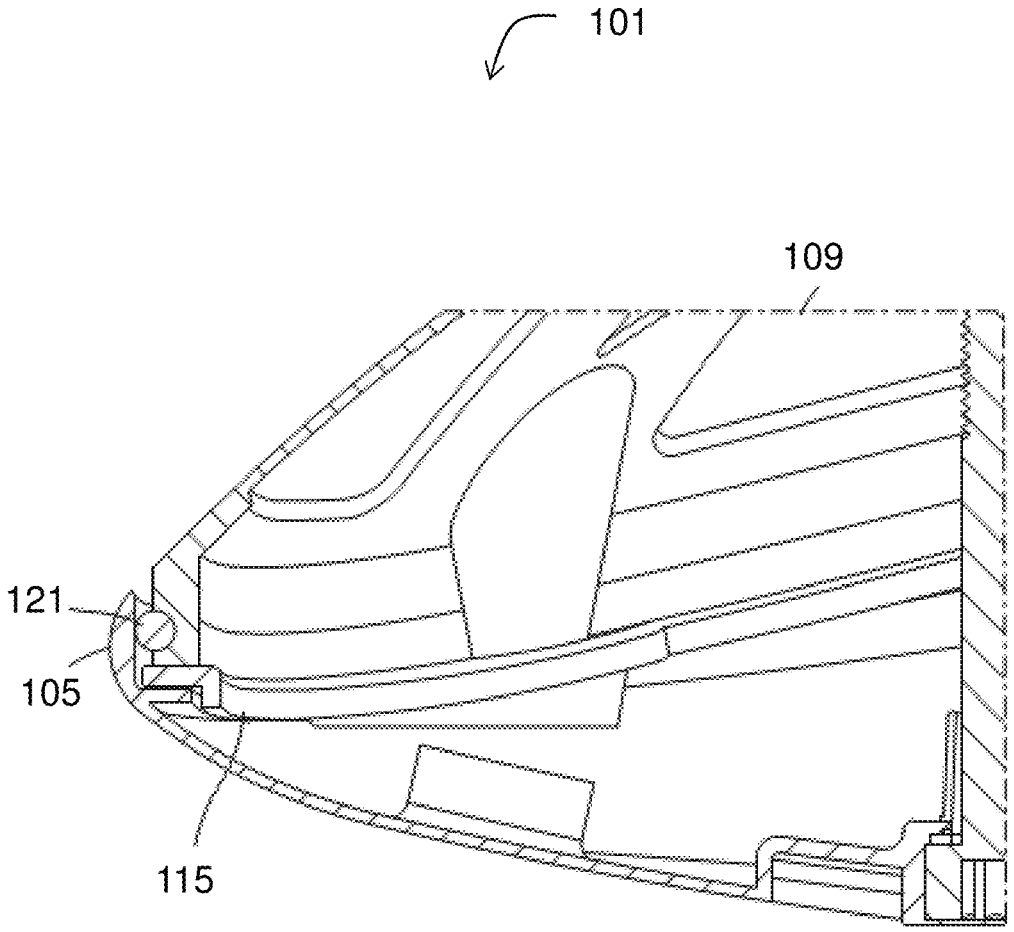
FIG. 5 illustrates the use of O-ring between a crown and club head body.

FIG. 5 illustrate the use of O-ring 121 to create a seal between removable crown 109 and club head body 105 when the crown if fastened into place. Gasket 115 helps seat crown 109 in the correct position and prevents vibration or rattle between the parts. O-ring 121 creates a moisture barrier and also can be replaced so that club head 101 provides enduring utility.

Figure 6:
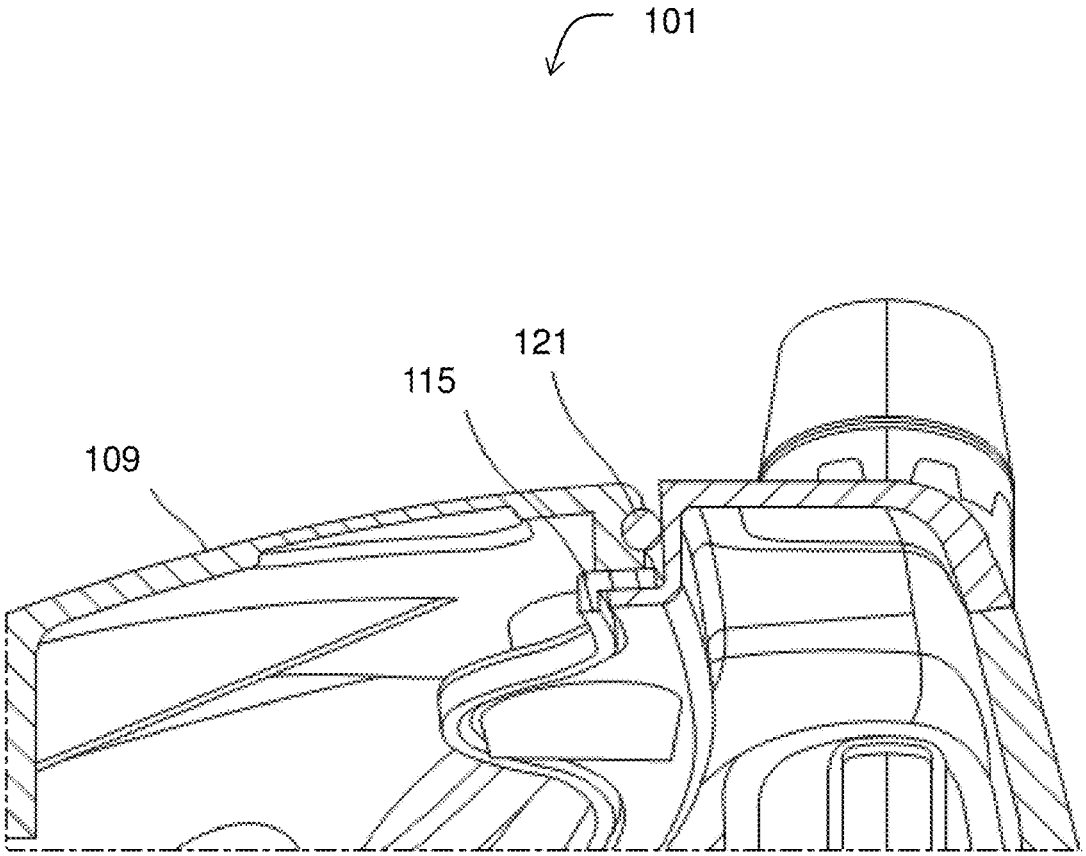
FIG. 6 shows a leading edge of connection between a crown and club head body.

FIG. 6 shows a leading edge of connection between crown 109 and club head body 105. Crown 109 seats on gasket 115 and O-ring 121 provides a seal.

Figure 7:
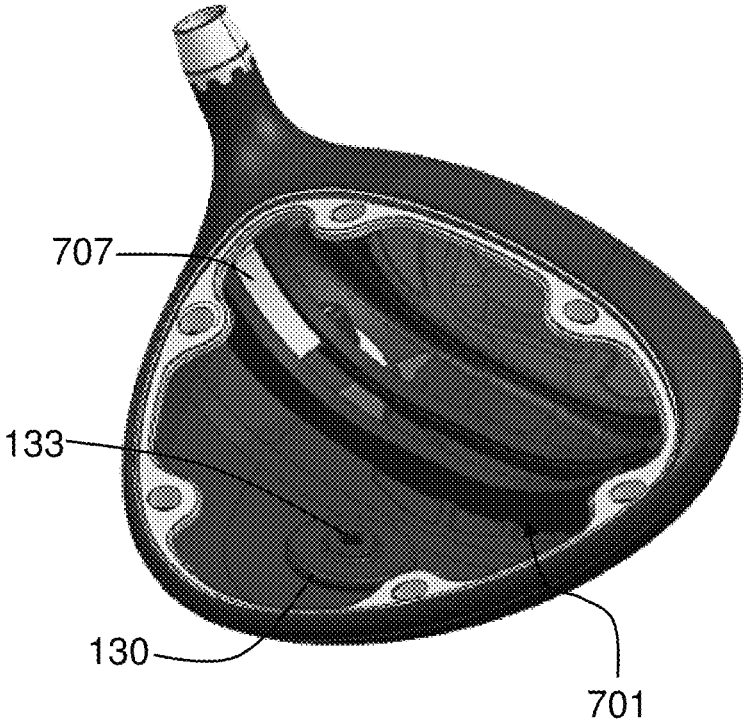
FIG. 7 shows a mounting track on an inner surface of the club head.

FIG. 7 presents an embodiment in which the mass adjustment mechanism comprises a mounting track 701 disposed on an inner surface of the club head body and a weight member 707 mounted on the mounting track. Preferably, weight member 707 is repositionable to any arbitrary position along mounting track 701. In the illustrated embodiment, mounting track 701 is disposed on the inner surface of the sole, extending substantially in a heel-toe direction. In certain embodiments, mounting track 701 defines a substantially straight line from the heel to the toe that is substantially parallel to the face. In other embodiments, the inner track system could be continuous or discontinuous on the inner perimeter edge of the club head. In other embodiments, the inner track system could extend from the face towards the aft section.

The illustrated internal track system offers benefits of making the internal weights more durable. The track has additional benefit of improving club head sound. For many golfers, auditory feedback is an important mechanism for understanding the hits that the golfer is presently making and muted or dull sounds can slow a golfer's progress in improving their skills. It may be found that weight track 701 improves the sound quality of club head 101. A significant benefit of track 701 is to provide many, even infinite, weight positions instead of a limited number of discrete positions. The advantage in the track weight design is that the design obtains the center position, as well as all the other positions in between. Club head 101 is well weighted with this design.

Figure 8:
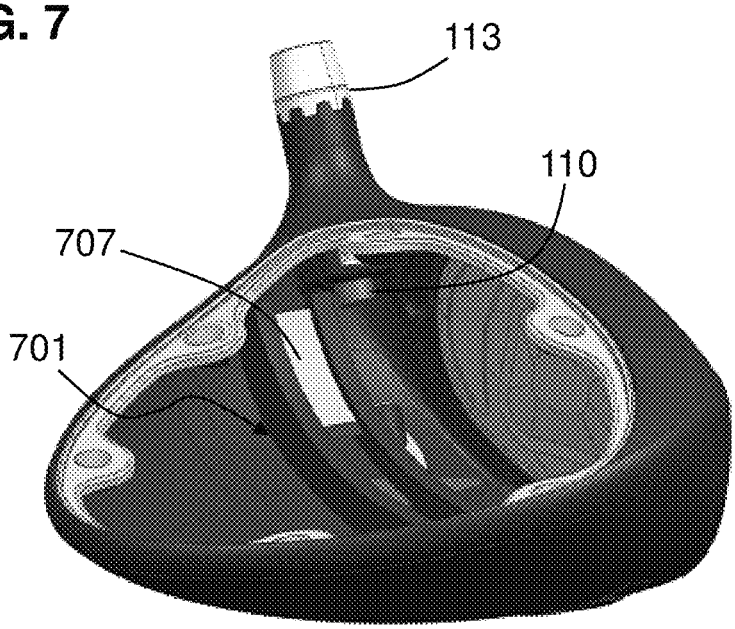
FIG. 8 illustrates a hollow, wood-type golf club head.

FIG. 8 illustrates an exemplary embodiment in which club head 101 is a hollow, wood-type golf club head and the club head body defines an enclosed interior volume, and further wherein the mass adjustment mechanism includes a mounting track 701 disposed on an inner surface of the club head body and at least one weight member 707 mounted on the mounting track 701. As shown in FIG. 8, weight member 707 can be moved along the track by removing the second body member from the club head body to access the at least one weight member.

As shown in FIG. 8, upon gaining access to the interior of the club head, a golfer may have access to a securing mechanism 110 (shown as a retention bolt) configured to secure a golf club shaft to the club head by way of the hosel 113. A golfer can manipulate the securing mechanism 110 (i.e., loosen the bolt) so as to remove the shaft in exchange for another. In some embodiments, the hosel 113 may be adjustable, such that a golfer can loosen the bolt and adjust the hosel (e.g., rotate the hosel about an axis of the shaft) so as to adjust a loft or lie angle of the club head. Embodiments of an adjustable hosel are disclosed in application Ser. No. 13/363,886, filed Feb. 1, 2012, and titled SETTING INDICATOR FOR GOLF CLUB, the contents of which are hereby incorporated by reference in their entirety. Since the securing mechanism 110 is internal and provided within the interior volume of the club head, the securing mechanism 110 is not subject to ground impact or environmental hazards during play.

Figure 9:
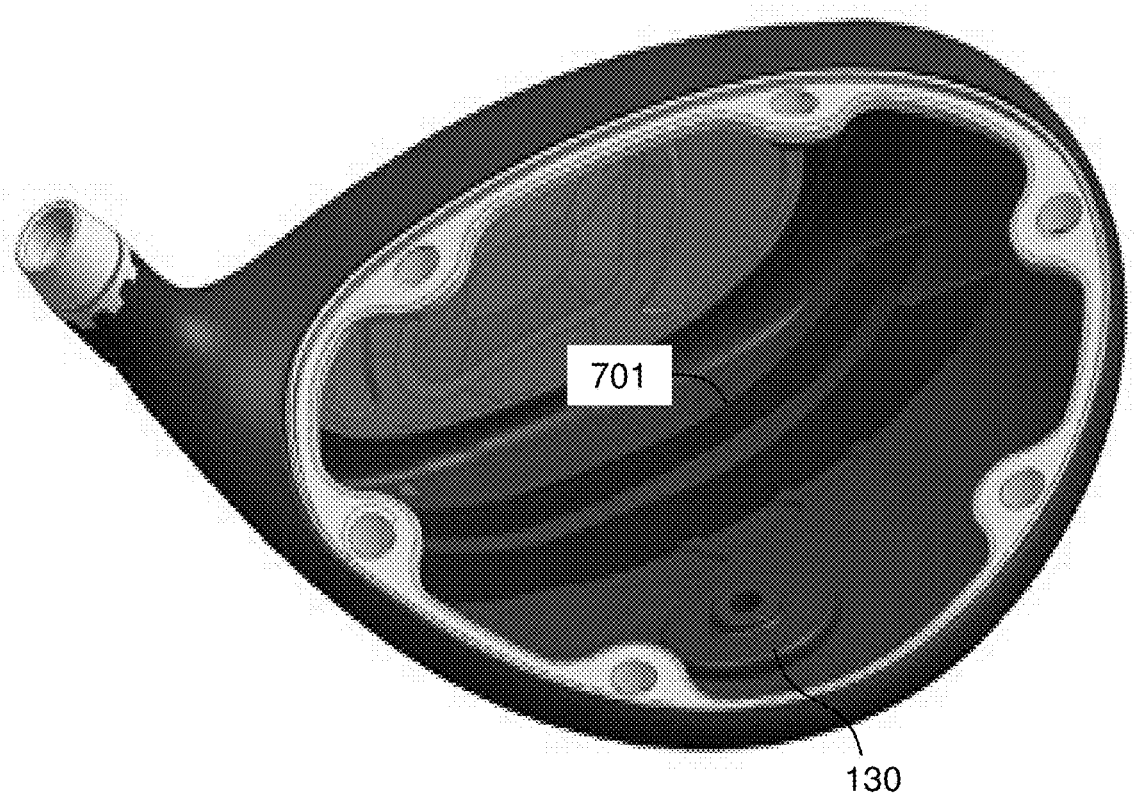
FIG. 9 shows a track and a weight mount point.

FIG. 9 illustrates an embodiment in which a club head 101 includes track 701 as well as a crown fastener mount point 130.

Other mass adjustment systems are provided by the invention for use in a golf club head.

Figure 10:
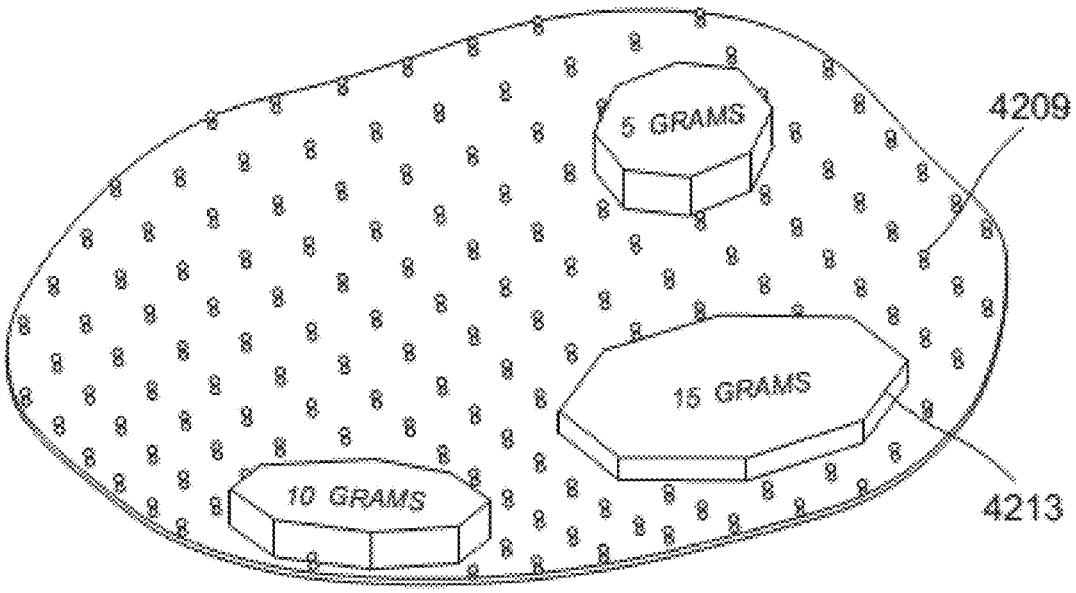
FIG. 10 shows an internal surface for a mass adjustment system.

FIG. 10 shows an internal surface for a mass adjustment system for a hollow golf club (e.g. driver). The illustrated mass adjustment mechanism includes one or more repositionable weight member 4213 having a surface configured to mount to an internal surface 4209 of the club head via a peg-and-hole press-fit system. A surface of weight member 4213 includes a plurality of holes configured to receive a corresponding plurality of pegs on the internal surface 4209 of the club head. Attachment pegs 4209 are fixed to the interior surface of the sole (or other interior or exterior surface) of the golf club head. Pegs 4209 can be provided by a metal, polymer, or other suitable material. Pegs 4209 may be formed as part of the sole material or attached after the sole shape is formed. The depicted mass adjustment system may include one or a plurality of weight members 4213 for attaching to pegs 4209.

Figure 11:
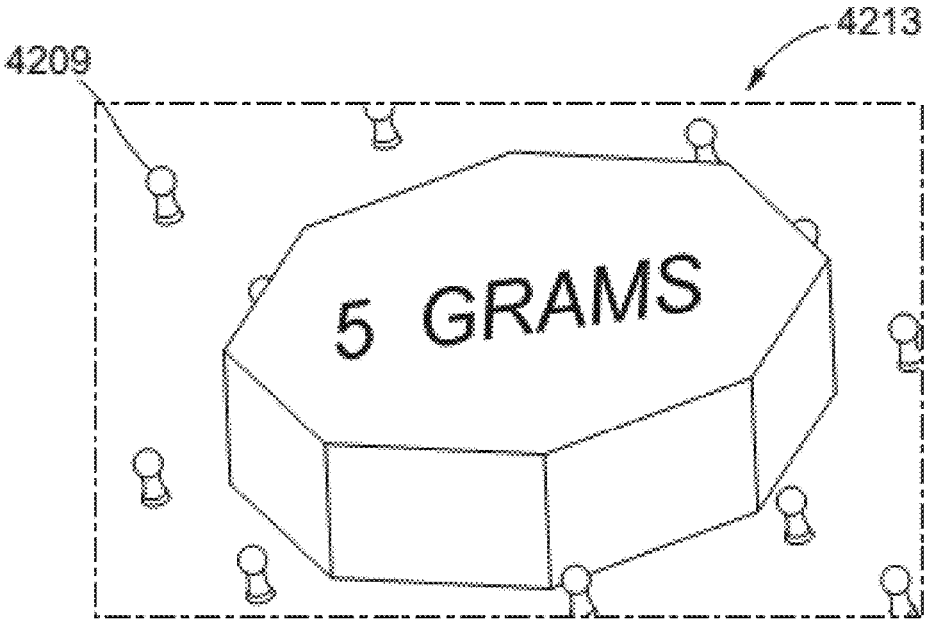
FIG. 11 gives a close-up of a weight member.

FIG. 11 gives a close-up of a weight member 4213. Weight member 4213 can include a pattern of holes on a bottom surface to correspond to a pattern of pegs 4209. In an alternative embodiment, weight member 4213 includes a material that is deformable enough that the weight member is initially whole and solid, but is pushed down over pegs 4209, causing the surface to break and receive pegs 4209 (e.g., a material like a rubbery gelatin) and may be made from silicone, rubber, a polymer, or a similar material. Weights 4213 can be made from a flexible polymer that forms to the shape of the sole surface and snaps onto the attachment pegs. Weights 4213 withstand the impact force when hitting the golf club, but can be removed by prying them off of the pegs. Weights 4213 may be various shapes, sizes, thicknesses and densities. Weights 4213 can be placed anywhere on the peg pattern to achieve desired performance attributes.

Figure 12:
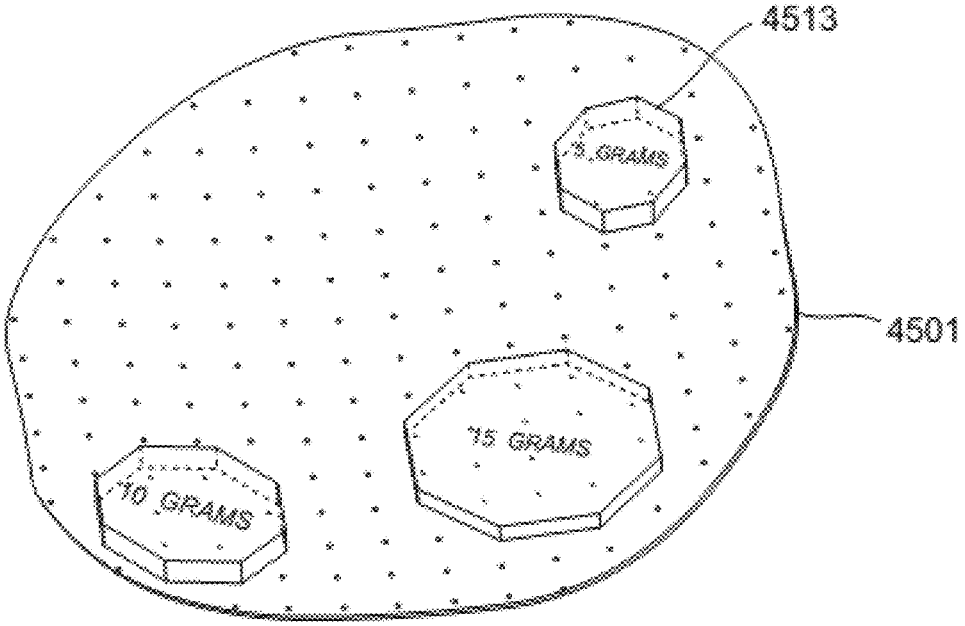
FIG. 12 shows a floor that includes holes for weight attachment.

FIG. 12 depicts a reversed embodiment in which a club head includes a false floor 4501 that includes holes for weight attachment. False floor 4501 is attached on the interior side of the sole of the golf club head. Weight member 4515 has a surface that bears a plurality of pegs configured for insertion into a corresponding plurality of holes on the internal surface of the club head.

Figure 13:
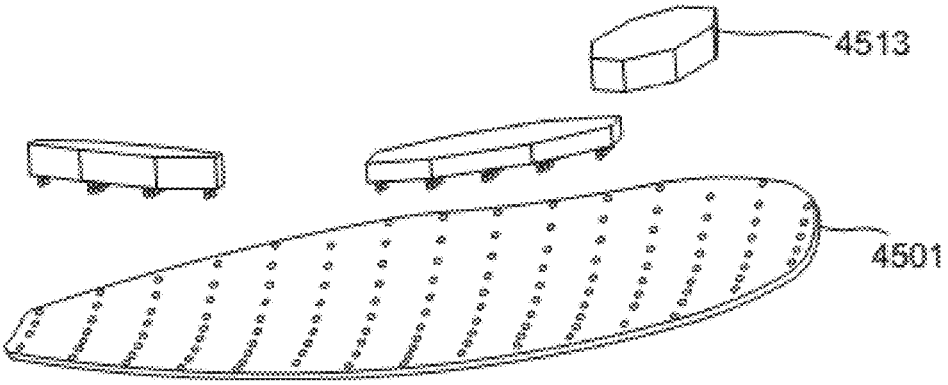
FIG. 13 shows weight members for attachment a floor.

FIG. 13 shows weight members 4513 for attachment to the holes in false floor 4501.

In some embodiments, a club head 101 of the invention includes a mass adjustment mechanism that uses one or a plurality of weight mount points.

Figure 14:
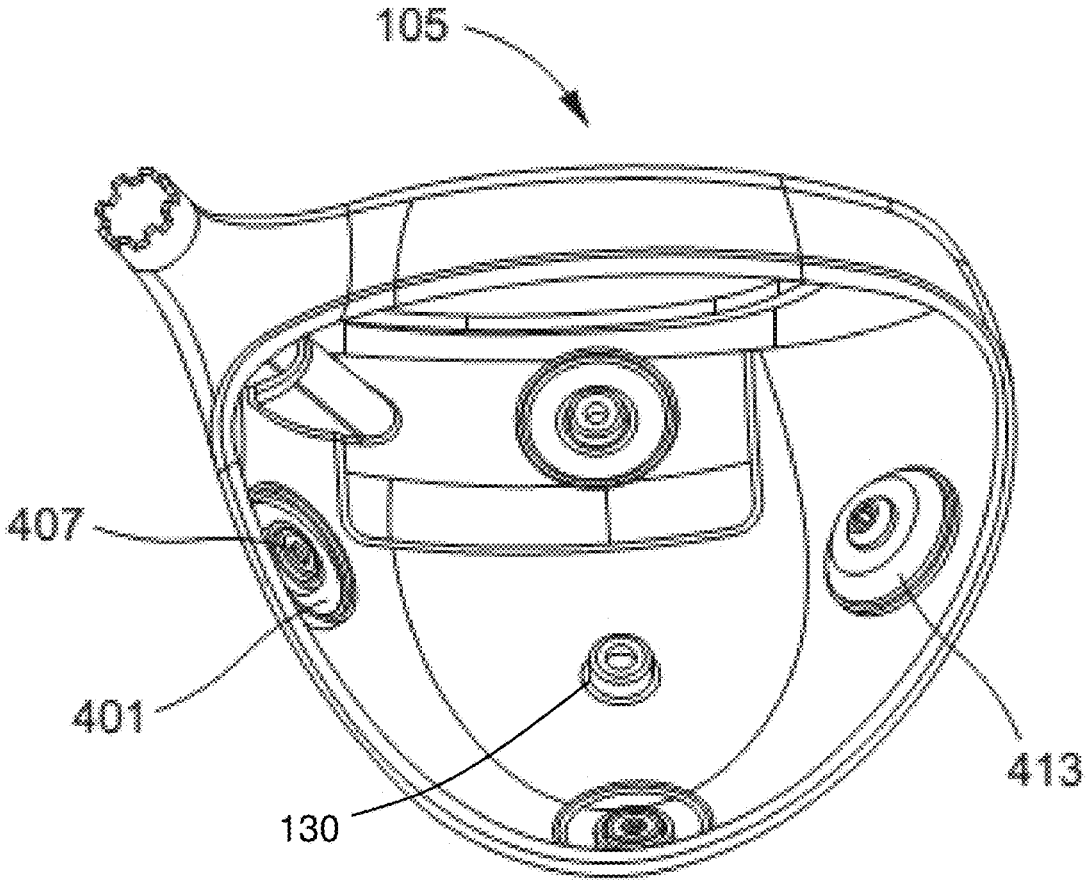
FIG. 14 shows a plurality of weight mount points.

FIG. 14 illustrates an adjustable mass system that includes a plurality of weight mount points 401. Each weight mount point 401 will typically include a mechanism 407 to which a removable weight may be affixed. Also shown in FIG. 14 is a removable or repositionable weight 413 affixed to a weight mount point 401 in a toe-side area of the inside of the sole of club head 101. Preferably, club head 101 is a hollow, wood-type golf club head (e.g., driver, fairway wood, or hybrid) and the club head body defines an enclosed interior volume, the mass adjustment mechanism includes one or a plurality of weight mount points.

Weight mount points 401 may be distributed in any suitable locations within club head 101. In general, it may be preferable to include points 401 on an interior of the sole 123 of club head 101 as golfers may find benefit in keeping a club head center of gravity low. Club head 101 may include any number of mount points 401, such as, for example, 1, 2, 3, 4, 5, 6, 10 s, etc. In the depicted embodiment, club head 101 includes four mount points 401—one at each of face side, heel side, toe side, and aft side of the interior of sole 123. In some embodiments, club head 101 is made to have a certain mass such that when a certain number of removable weights 413 (e.g., one or two) are included, the overall mass of club head 101 is a desirable value.

Figure 15:
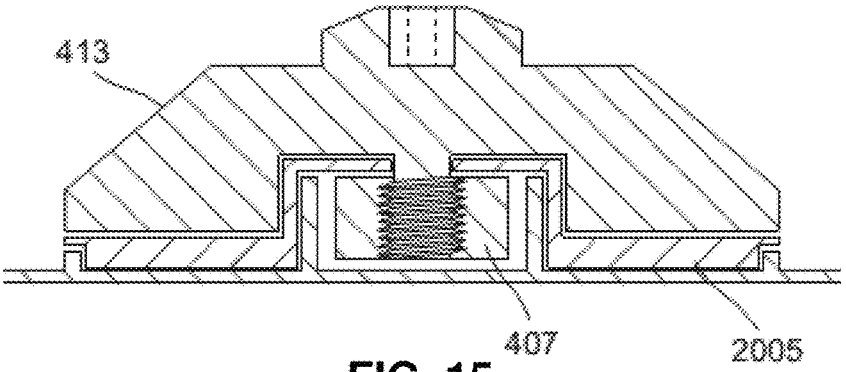
FIG. 15 shows a relationship between a repositionable weight and a weight mount port.

FIG. 15 illustrates a relationship between removable or repositionable weight 413 and weight mount port 401. Removable or repositionable weight 413 is configured for threaded attachment to one of the plurality of weight mount points 401. Weight mount point 401 includes a mounting mechanism—here, a threaded socket 407. Threaded socket 407 may be fixed into, or created within, weight mount point 401 by any suitable mechanism, such as welding, glue, press-fit, or others. In some embodiments, weight ports are cast as part of the surrounding component and threads are then tapped in. In certain embodiments, the area of the club head defines a casting (e.g., with Ti) and threads are then machined in.

Removable weight 413 includes a corresponding threaded post (and may also include a gasket, washer, or other mechanisms, to mitigate vibration and aid in good fit). Removable weight 413 can thus be fixed into, or removed from, an interior of golf club head 101 via a threaded interface. Removable weight 413 preferably includes a tool interface on an exterior surface. FIGS. 15-28 illustrate constructions of removable weights 413 according to embodiments of the invention.

FIG. 15 illustrates a two-piece construction for removable weight 413. Removable weight 413 sits in mount point 401, which may be, for example, cast in titanium (e.g., where a portion of or all of a sole 123 of club head 101 is titanium). Removable weight 413 may be made of a dense material such as tungsten alloy. Disposed between the weight and the mount point is a polymer gasket 2005. In some embodiments, polymer gasket 2005 is adhered to the bottom surface of the tungsten alloy removable weight 413. Inside of the casting for the mount point is a threaded insert 407 (e.g., adhered to the Ti casting) or threads (e.g., tapped in) to receive threaded post of removable weight 413. Polymer gasket 2005 may preferably include both horizontal walls as well as vertical walls surrounding the Ti casting of mount point 401 to aid in dissipating shear stresses associated with a ball strike.

Figure 16:
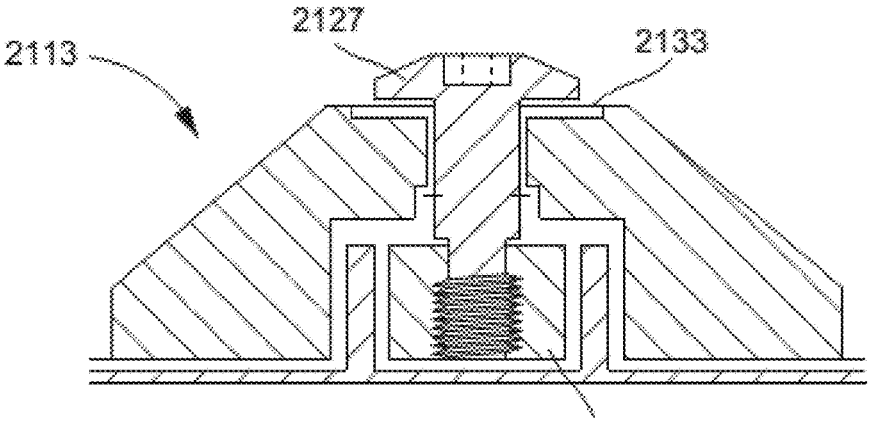
FIG. 16 shows a removable weight that includes a screw member.

FIG. 16 shows an alternative embodiment in which a removable weight 2113 includes a screw member 2127 extending through the weight body. A washer 2133 may be disposed between the head of the screw and the weight body. Optionally, a retaining ring may be included. Screw member 2127 mates with threaded insert 407.

Figure 17:
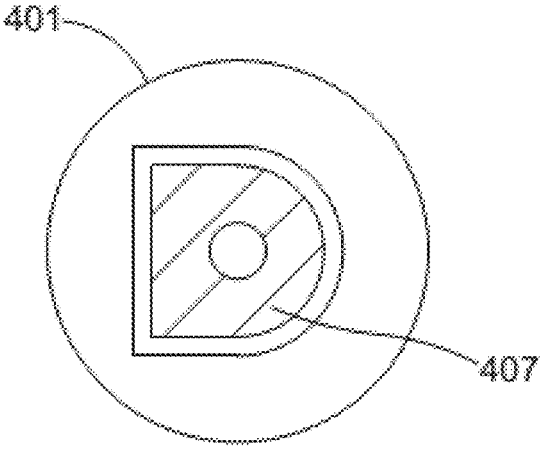
FIG. 17 shows a threaded insert and a casting of a mount point.

FIG. 17 depicts a relationship between threaded insert 407 and the casting of mount point 401. By including a flat edge, a spline, a corner, or an irregularity, threaded insert can be prevented from rotating within mount point 401. Threaded insert may have any suitable shape such as rectangle, star-shaped, hexagon, etc.

Figure 18:
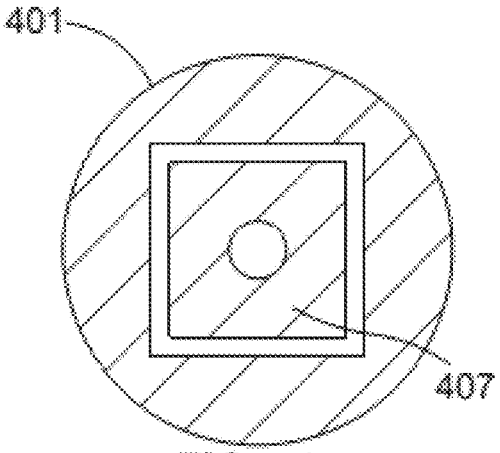
FIG. 18 shows a square cross-sectional shape to prevent rotation.

FIG. 18 illustrates an embodiment in which threaded insert 407 has a square cross-sectional shape to prevent rotation within mount point 401.

Figure 19:
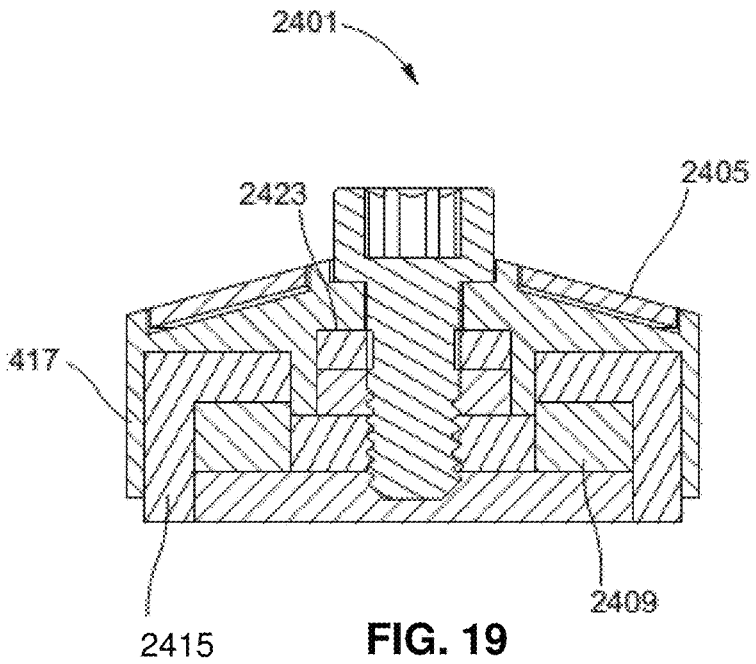
FIG. 19 shows a removable weight.

FIG. 19 shows an embodiment for a removable weight 2401. Cover 2417 defines an overall shape of removable weight 2401. Cover 2417 houses insert 2415 that provides mass. Insert 2415 can be any material of a desired density and may be, for example, tungsten-loaded rubber.

In some embodiments, insert 2415 further houses a ring member 2409 for additional weighting. Ring member 2409 may be varied to give weight 2401 a desired mass. For example, ring member 2409 may be a steel ring selected from a set of varying thickness, or ring member 2409 may be made from any other suitable material. Cover 2417 may sport medallion 2405. By including a separate medallion 2405, different information may be added to weight 2401 after its intended mass is set (e.g., by inserting one or a plurality of ring member 2409). Thus, a plurality of cover 2417 can be manufactured uniformly and used to create a variety of different weights 2401. Different weights 2401 can include different masses through the variation of ring member 2409 and the different masses can be communicated to the user by affixing a different medallion 2405 to the cover 2417.

In certain embodiments, different weight members have different masses by having differing densities in their constituent materials. For example, a weight member body or screw may be made with metals or other materials of different densities (e.g., some tungsten screws, some aluminum screws, etc.)

Removable weight 2401 includes a screw extending therethrough for coupling to threaded insert 407. In some embodiments, removable weight 2401 will include a retaining washer 2423 (e.g., rubber) to hold the screw inside of the weight.

Figure 20:
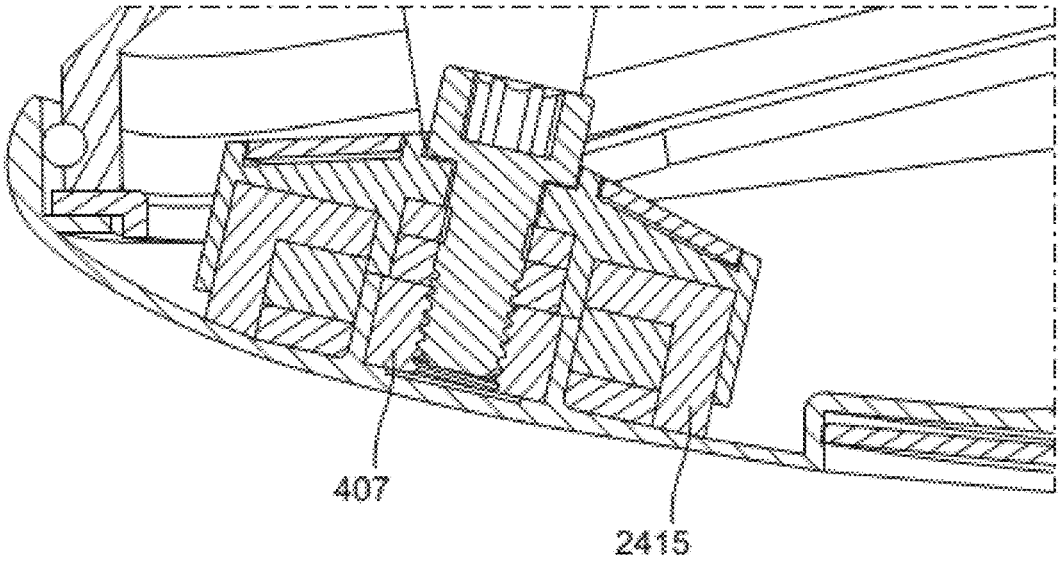
FIG. 20 shows removable weight installed in a club head.

FIG. 20 shows removable weight 2401 installed in club head 101. Weight 2401 is mounted to point 401 on an inside surface of the sole 123 of club head 101 via threaded insert 407 fixed therein (e.g., by glue). In the depicted embodiment, it will be noted that the cover 2417 defines an inner cylinder member that sits on the extended cylindrical wall of mount point 401. It may be found preferable to have weight 2401 bottom out, when being screwed into place, by having cover 2417 push against the protruding portion of mount point 401, as depicted. Since insert 2415 is preferably a pliable material such as rubber, the lowermost surface of insert 2415 deforms to conform to the curved inner surface of sole 123 thereby stabilizing removable weight 2401 inside of club head 101.

Since club head 101 can be opened and includes removable or repositionable weights, mass properties of the club head can be adjusted. In some embodiments, club head 101 can be opened by a golfer and re-closed (e.g., as many times as he or she would like). In certain embodiments, club head 101 is open initially, and is fitted to a golfer one time by adjusting the positions of the weights, and then closed and can optionally be sealed shut (e.g., by adhesive) once the club head is fitted to the golfer. Additionally, the club head may be provided with information to guide the positioning of weights. Information may be provided in the form of a color scheme, or labels on the weight mount points 401 or with an informational pamphlet, web page, computer program, or smart phone app that is made available to guide a golfer in locating weights.

A weight adjustment mechanism inside of a golf club head according to the present invention may include any suitable mechanism such as, for example, threaded, non-threaded, snap-together, adhesive based, or other assembly mechanism.

Figure 21:
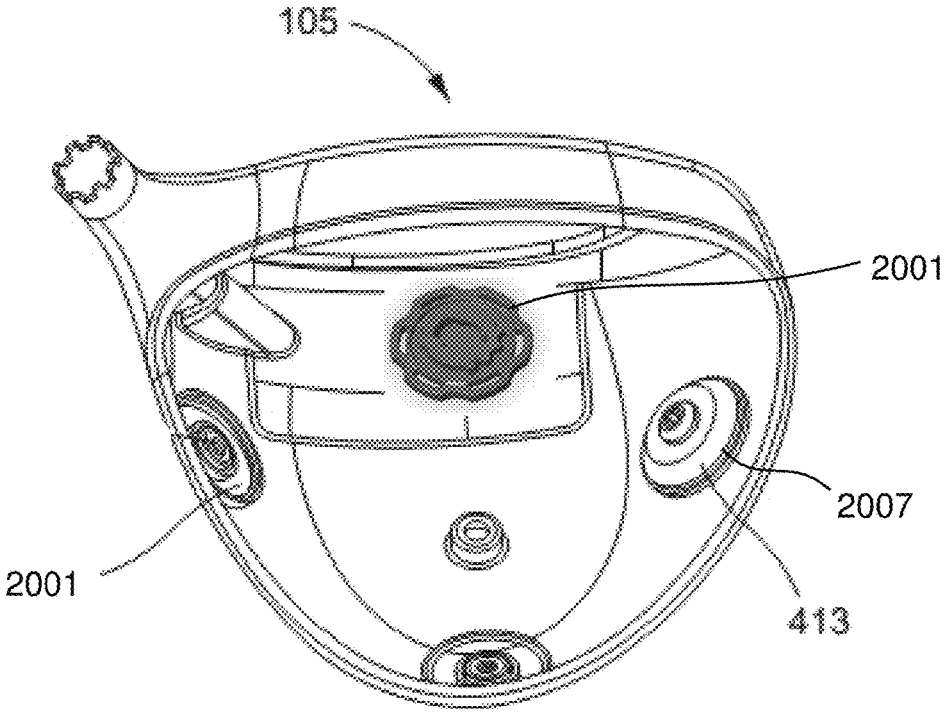
FIG. 21 shows an internal weight assembly.

FIG. 21 shows an internal weight assembly in which a weight member 2007 is configured to be inserted through a weight mount point 2001 and twisted to lockdown the weight (e.g., by hand or using a wrench). Preferably, weight mount point 2001 comprises a slot and club head 101 includes a detachable weight 2007 member having a tab configured for insertion into the slot, wherein rotating tab inside of the slot fastens the weight member to the mount point 2001.

Figure 22:
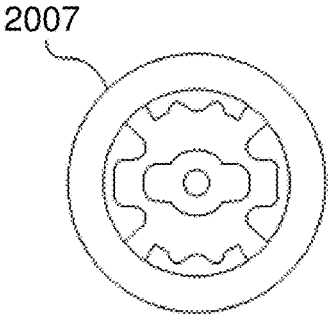
FIG. 22 illustrates the attachment side of weight member.

FIG. 22 illustrates the attachment side of weight member 2007. A central post has one or more protruding tabs that can be inserted through a slot in mount point 2001.

Figure 23:
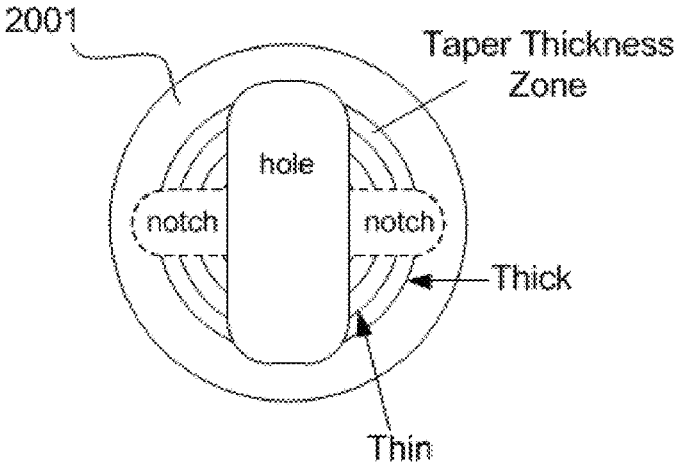
FIG. 23 shows a slot from the inside of weight mount point.

FIG. 23 shows slot 2001 from the inside of weight mount point 2001. The dotted line shows a receiving notch inside of the mount point and oblique to the slot. A user can push weight 2007 in and twist it to fix it into place.

A mass adjustment system can be additive or subtractive. Additive mass systems have been illustrated and discussed above. An additive system is based on a minimum head structure that provides acceptable durability, sound, and ball launch conditions. The additive system uses mass that may be added. Additive mass may be provided by heavy tape, glued-in weights, screwed-in weights, "snap-in" weights, or any combination of them all to establish the optimum head weight, CG position and moment of inertia. In some embodiments, the head is originally formed through casting, stamping or composite build-up with no discretionary weight onboard—i.e. it is a light weight head. The head has basic functionality with good sound, acceptable durability, and acceptable golf ball launch conditions. Weight pad areas may be designated inside the head, for example, with markings for the placement of discretionary mass. Weights are located in specific combinations on the pad areas to obtain the desired head weight, center of gravity location, and moment of inertia. Weights can be heavy tape (commonly known as "lead tape"), snap-on, heavy metal infused thermoplastic, heavy metal infused rubber, heavy metal infused glue (i.e. "rat glue"), glued-on mass, screws, or others.

A subtractive system generally involves a club head that is manufactured to have a mass greater than a desired mass, such that the club can be customized by selectively removing mass. For example, a subtractive system may include specifically located weight pads that are molded (e.g., cast) into the head that can be machined away to establish the optimum head weight, CG position, or moment of inertia.

Figure 24:
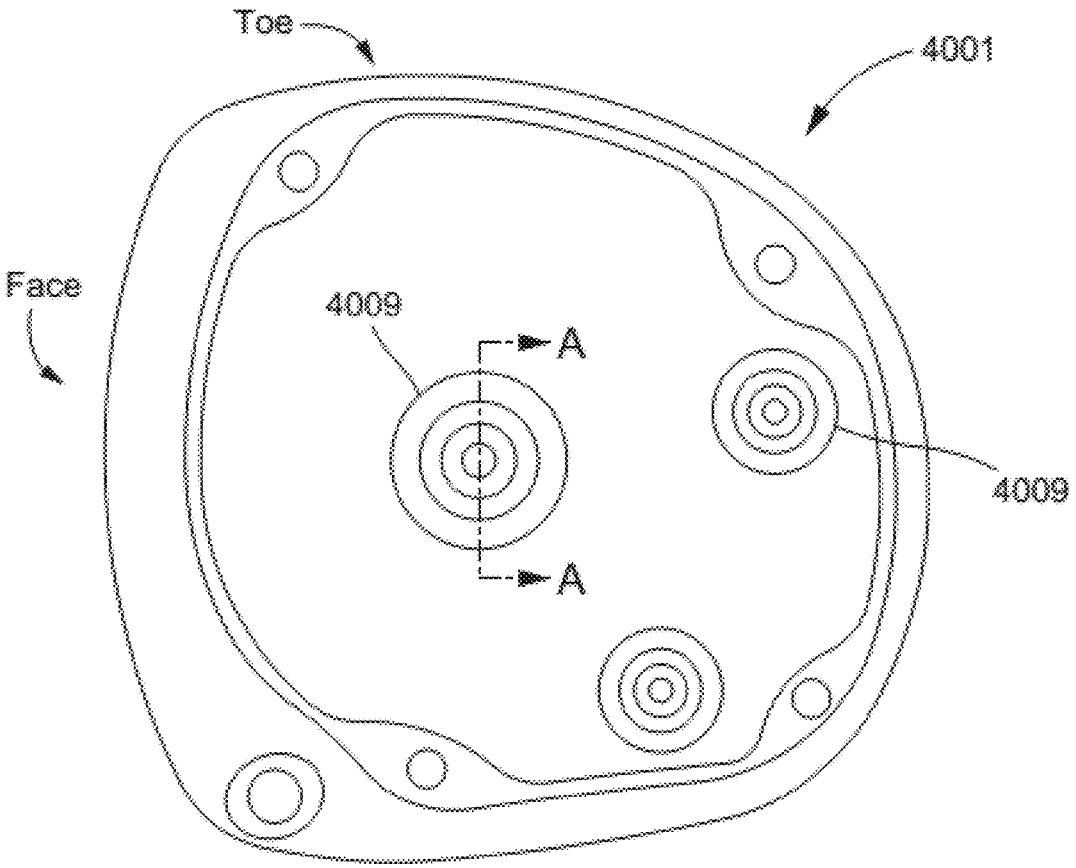
FIG. 24 shows a club head with a subtractive mass adjustment system.

FIG. 24 shows a club head 4001 with a subtractive system. Club head 4001 includes a plurality of mass pads 4009. Pad can be taken to mean a defined or raised area (e.g., in the sense that a concrete "pad" is poured when building a shed). Weight pads 4009 are preferably areas of the overall body shell of club head 4001 that are thicker than the surrounding areas. Weight pads 4009 are incorporated into the head (cast, stamped, welded) and the baseline head has excessive discretionary mass—i.e. it is heavy. The head has basic functionality, good sound, acceptable durability and acceptable golf ball launch conditions.

Figure 25:
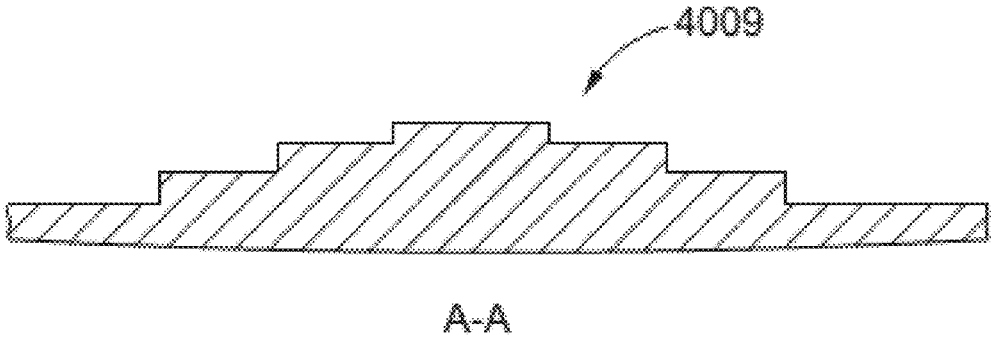
FIG. 25 gives a cross-section through a weight pad in a subtractive system.

FIG. 25 gives a cross-section through a weight pad 4009 as manufactured initially in a club head 4001 with a subtractive system. The weight pads may be machined away in a specific pattern to obtain desired head weight, center of gravity location and moment of inertia. For example, a consultant at a pro-shop can use a rotary tool, such as the rotary tool sold under the trademark DREMEL with a grinding attachment, and can remove weight pads 4009 to bias the club head according to a golfer's swing style.

In other embodiments of the invention, the mass adjustment mechanism inside of club head 101 operates via one or more mount points that define pockets configured to receive a weight member.

Figure 26:
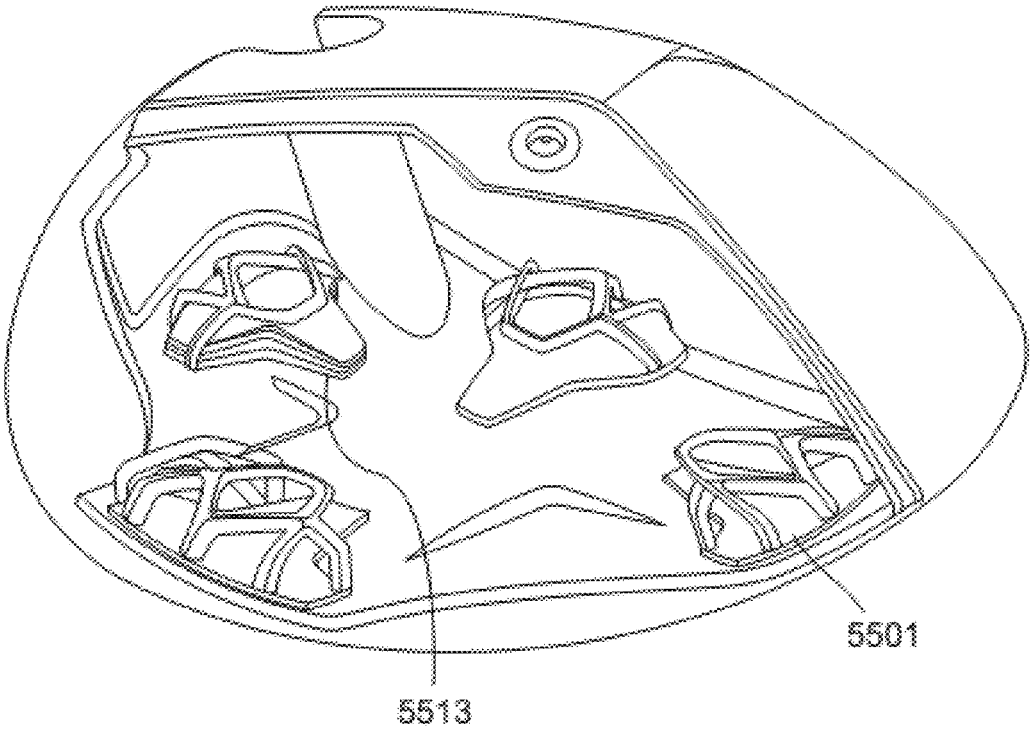
FIG. 26 shows mount points retaining weight members.

FIG. 26 shows mount points 5501 retaining weight members 5513. Here, weight members 5513 are non-round and thus unable to rotate in place once retained in cage-like, or pocket-like, mounting points 5501.

Figure 27:
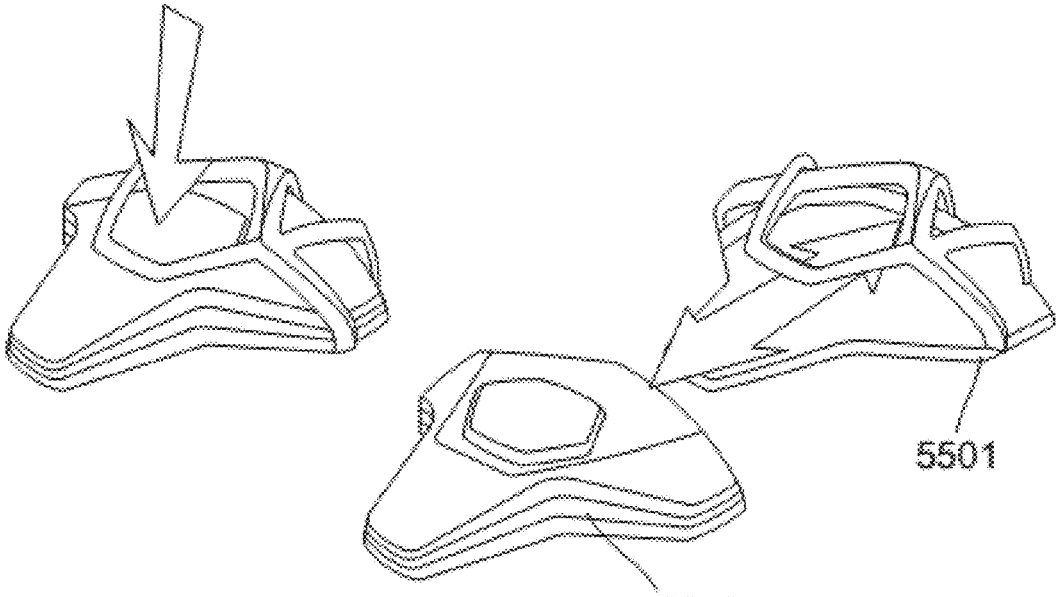
FIG. 27 shows a mount point and a weight member.

FIG. 27 shows a mount point 5501 and a weight member 5513 as shown inside of a club head in FIG. 26. It can be seen that weight members 5513 may include a button that can be pressed to release them from mount points 5501 and that weight members may be inserted by sliding them into mount points 5501. It may be found preferable to use non-round weight members so that they do not rotate during use of the club head. The cage shape of mount points 5501 may be preferred for fastening the weight members therein.

Figure 28:
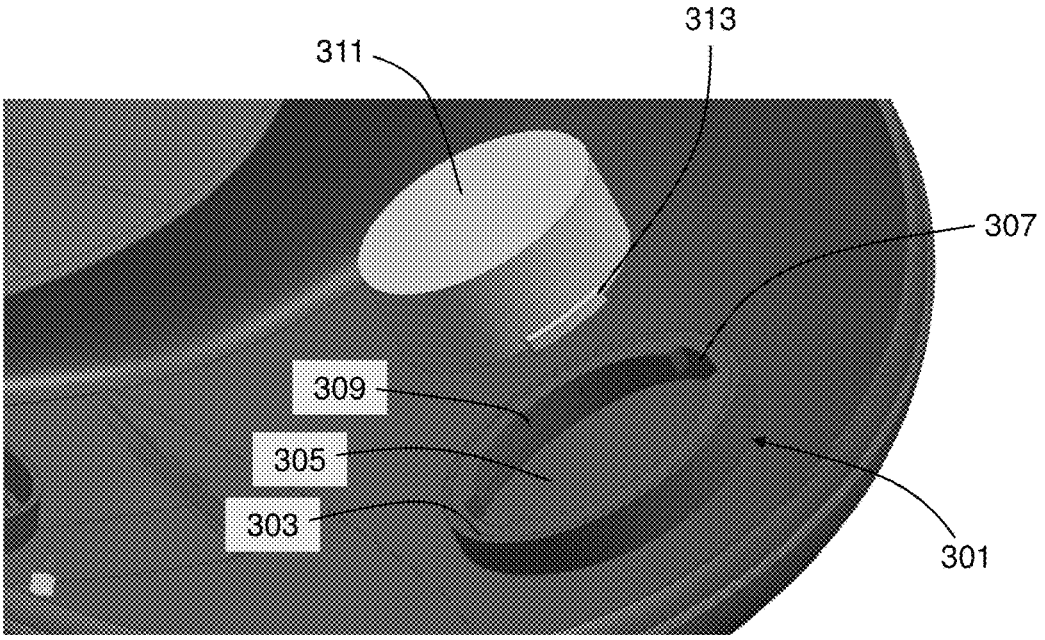
FIG. 28 shows another embodiment of an internal weight assembly.

FIG. 28 shows a mount point 301 for receiving a weight member 311 as shown inside of a club head. In this embodiment, the mount point 301 includes a raised wall 303 defining a generally annular shape and forming a cavity 305 within shaped and/or sized to receive at least a portion of the weight member 311 within. The weight member 311 is secured to and retained within the mount point 301 by way of a track 309 formed within an inner surface of the wall 303 and extending along a perimeter thereof. For example, the weight member 311 may include one or more flanges 313 to be received within one or more associated slots 307 formed within the wall 303. The slots 307 are communicatively coupled to the track 309, such that, upon insertion of the flanges 313 into the respective slots 307, a golfer need only rotate the weight member 311 (e.g., a quarter turn) so as to slide the flanges 313 from the slots 307 into the track 309 until the flanges 313 are no longer in alignment with the slots 307. The track 309 is shaped and/or sized to retain the flanges 313 within, thereby securing the weight member 311 to the mount point 301. The track 309 may further include pockets or recessed portions 314 shaped and/or sized to receive associated flanges 313 so as to establish a secure coupling of the weight member 311 to the mount point 301.

Figure 29:
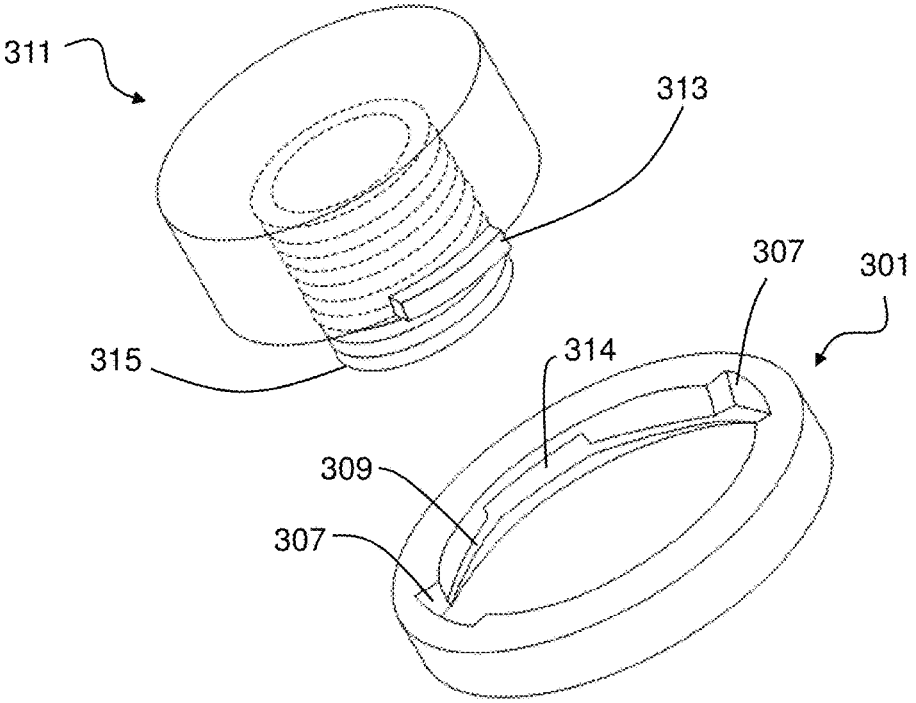
FIG. 29 shows a removable weight that includes a spring member.

For example, FIG. 29 shows a removable weight member 311 that includes a spring member 315 and a more detailed view of the mount point 301. The spring member 315 is adapted to apply a biasing force upon insertion of the weight member 311 into the mount point 301, thereby further enhancing the coupling of the weight member 311 to the mount point 301. For example, upon alignment and insertion of the flanges 313 of the weight member 311 into the respective slots 307, the spring member 315 applies a biasing force against the weight member 311 and the mount point 301 that is partially overcome upon a golfer pushing the weight member 311 towards the mount point 301. Upon rotation of the weight member 311 so as to slide the flanges 313 into engagement with the track 309 and further into alignment with the recessed portions 314, the spring member 315 continues to apply a biasing force resulting in securement of the flanges 313 within the recessed portions 314. In the event that a golfer wishes to remove the weight member 311, they need only disengage the coupling of the flanges 313 from the associated recessed portions 314 of the track 309 (by pushing the weight member 311 towards the mount point 301 to partially overcome the biasing force of the spring member 315) and then rotate the weight member 311 until the flanges 311 are in alignment with associated slots 307, at which point, the weight member 311 may pop out due to the biasing force from the spring member 315.

Figure 30:
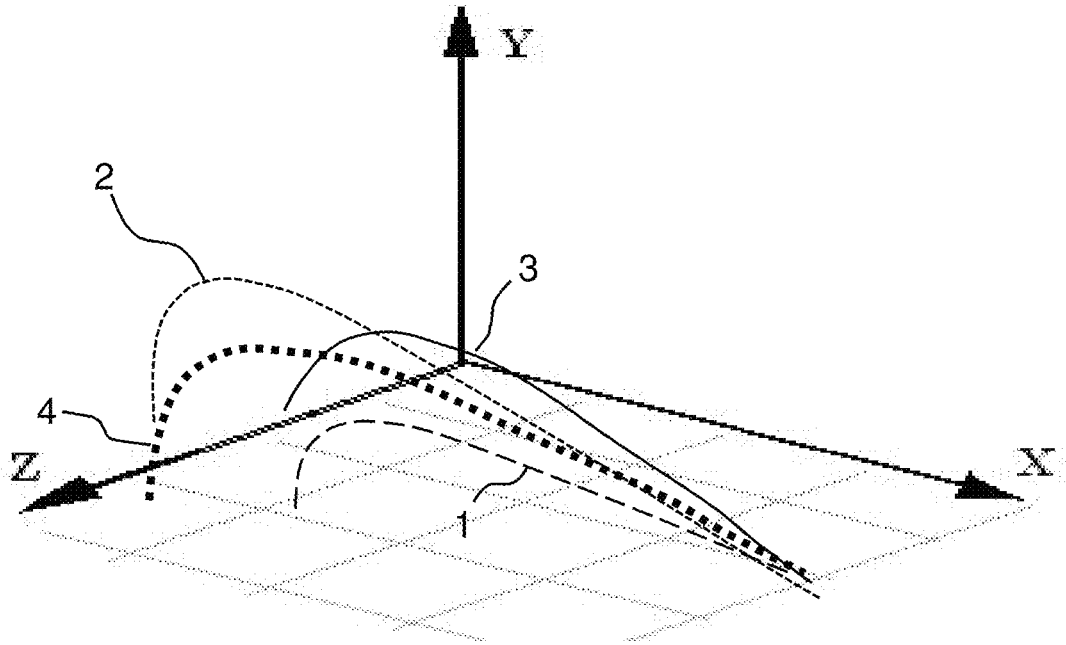
FIG. 30 illustrates types of adjustments that may be made using systems of the invention.

FIG. 30 illustrates types of adjustments that may be made using systems of the invention. FIG. 28 additionally illustrates material that may be provided to a golfer to aid in using a system of the invention (e.g., printed or digital). The graph depicts flight trajectories that may be favored by different adjustments to mass distributions. A mass adjustment system may be labeled to correspond to positions on the depicted graph, thus informing a golfer of how to adjust the mass via the mass adjustment system to obtain a desired correction in ball flight trajectory.

Figure 31:
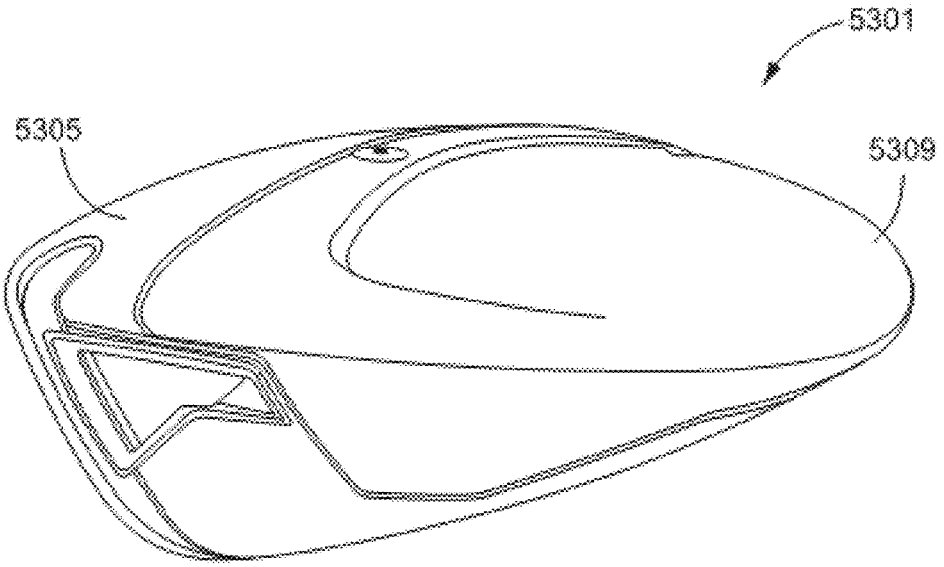
FIG. 31 depicts a golf club head in which an interior of the club head is accessible.

FIG. 31 depicts a golf club head 5301 that includes a club head body 5305 comprising a sole, a crown, a face, and a hosel, and in which an interior of the club head is accessible for adjustment. Club head 5301 is a hollow, wood-type club head that is accessible by means of an opening mechanism. As shown in FIG. 31, the opening mechanism, when open, provides an aperture giving access into an interior volume of the club head body that is enclosed with the opening mechanism is closed, wherein the aperture has an open area of at least 3 $cm^2$.

Figure 32:
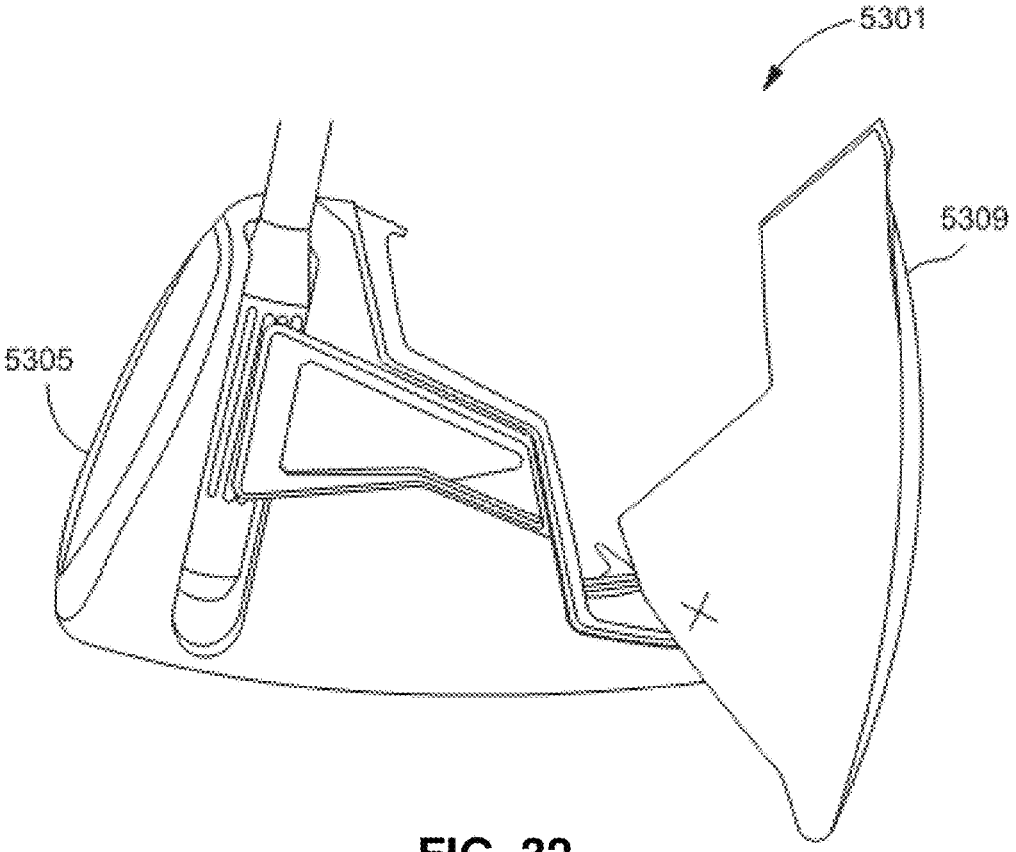
FIG. 32 shows a club head in an open state.

FIG. 32 shows club head 5301 in an open state, showing that the opening mechanism has an openable portion 5309 that is configured to be opened without being removed from club head body 5305. Openable portion 5309 is attached to the club head body via a hinge. Club head 5301 may include an adjustment mechanism within club head body 5305 for adjusting a property of the club head.

Figure 33:
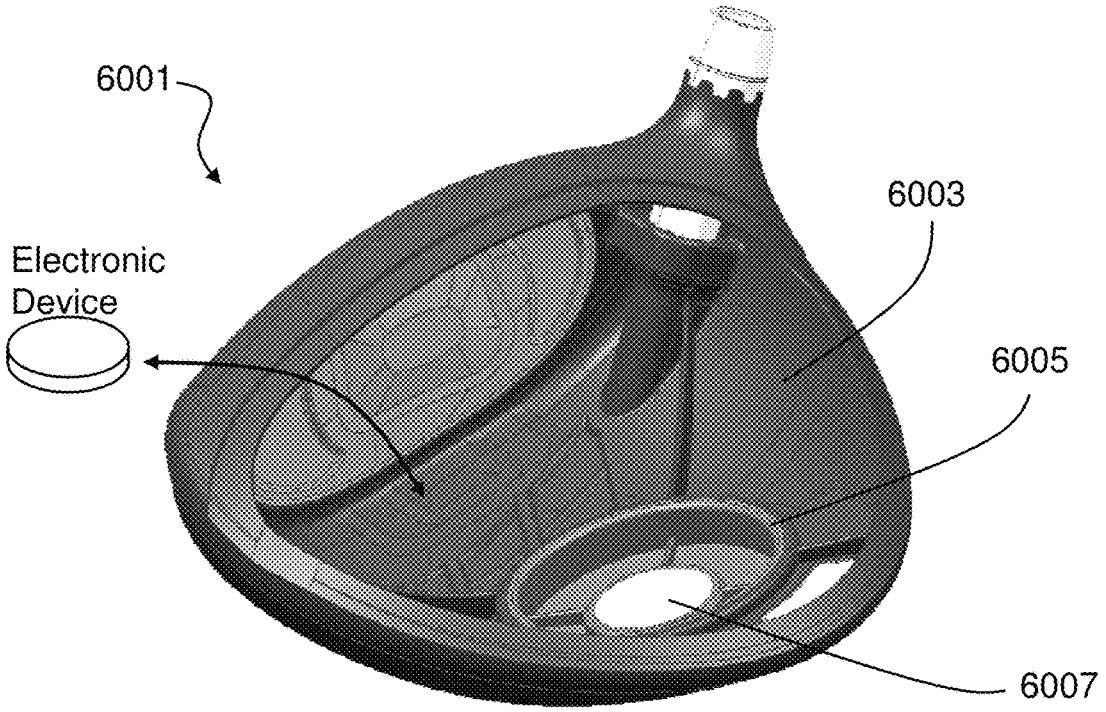
FIG. 33 shows a perspective view of golf club head, partly in section, including a viewing portal.
Figure 34:
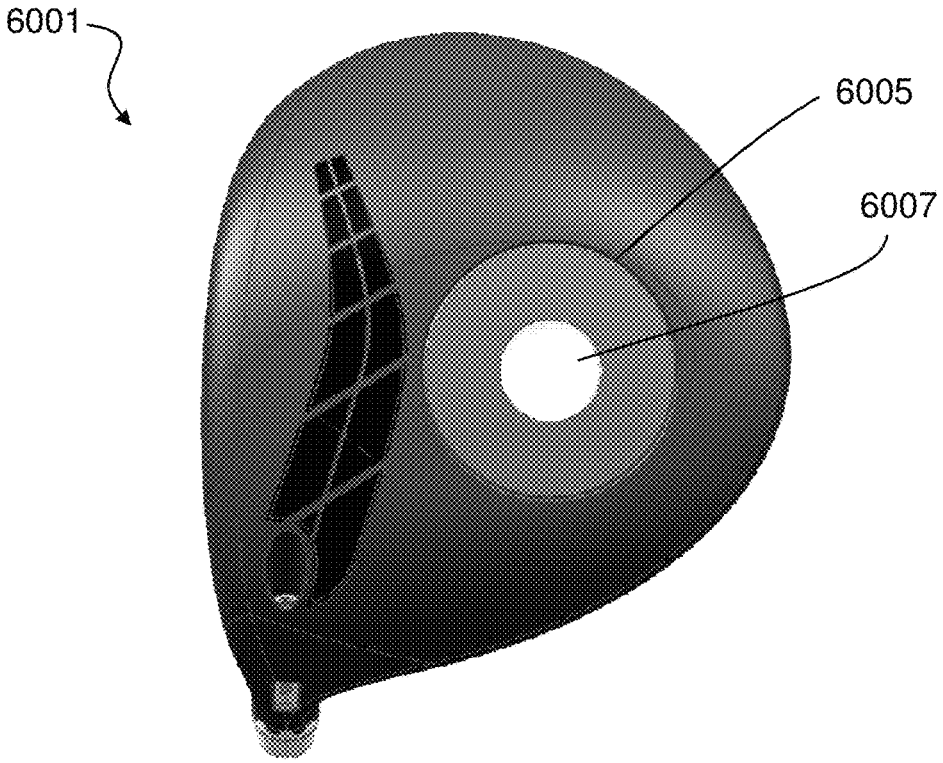
FIG. 34 shows a bottom view of the club head of FIG. 33.

FIG. 33 is a perspective view, partly in section, of golf club head 6001 including a viewing portal 6005 positioned on a portion thereof. FIG. 34 shows a bottom view of the club head 6001 of FIG. 33. In some embodiments, a golf club head consistent with the present disclosure may include a portal 6005 for providing a view into the interior 6003 of the club head 6001. As shown, The portal 6005 may generally include a body portion having a viewing portion 6007 coupled thereto, wherein the viewing portion 6007 is comprised of a material capable providing an internal view of the club head, such as a transparent or translucent material. The viewing portion 6007 may further be comprised of a durable and/or scratch-resistant, so as to withstand impact forces accompanied with use of the club head 6001. It should be noted that, although depicted as being positioned on the sole, the viewing portal 6005 may be positioned on any portion of the club head (e.g., crown, toe, heel, skirt, ball-striking face, etc.). The viewing portal 6005 may be coupled to the club head 6001 by any known means. In the illustrated embodiment, the viewing portal 6005 is coupled to the sole in a threaded engagement (e.g., the viewing portion 6005 has external threads configured to engage an internally threaded bore). In other embodiments, the viewing portal 6005 may be coupled to the club head 6001 via a fastener or via bonding with adhesives or cements, welding (e.g., laser welding), soldering, brazing, or other fusing techniques, etc.

The viewing portal 6005 may be included on any one of the embodiments of club heads consistent with the present disclosure. As such, the viewing portal 6005 may be particularly advantageous when included on a club head with an accessible interior. For example, rather than having to gain physical access to the interior of the club head so as to gain access to an adjustment mechanism positioned on the interior of the head, the viewing portal 6005 provides a golfer with a view to the interior, thus saving time and effort. It should be noted that the golf club and club head structures previously described herein were described in terms of wood-type golf clubs. However, the present invention is not limited to the wood-type clubs, but applies to golf clubs generally, including hybrid clubs, iron-type golf clubs, utility-type golf clubs, and the like.

Figure 35A:
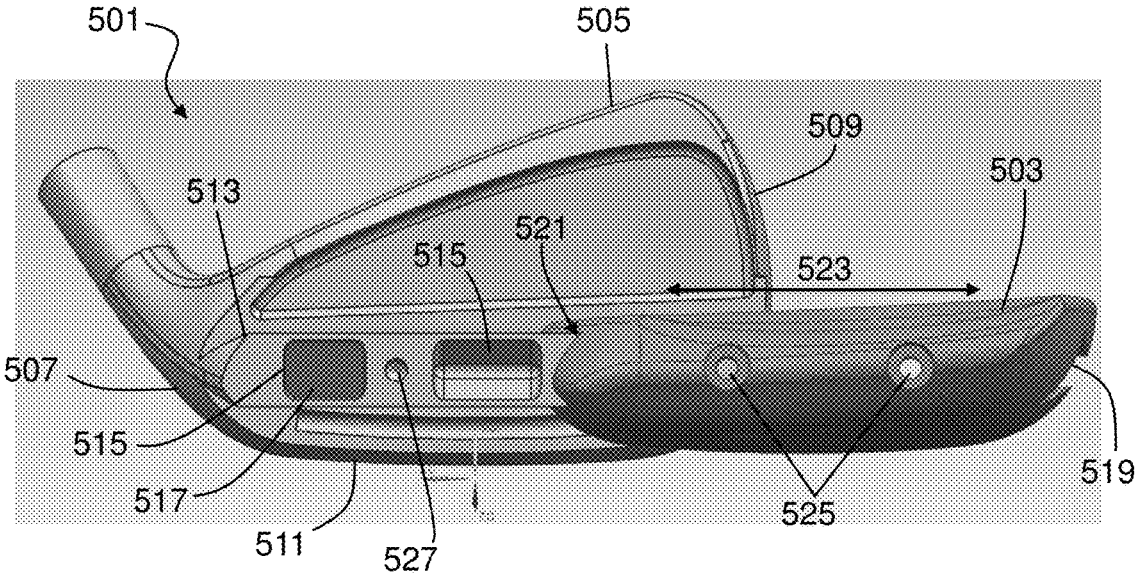
FIGS. 35A-35C show an iron-type club head with an accessible interior.
Figure 35B:
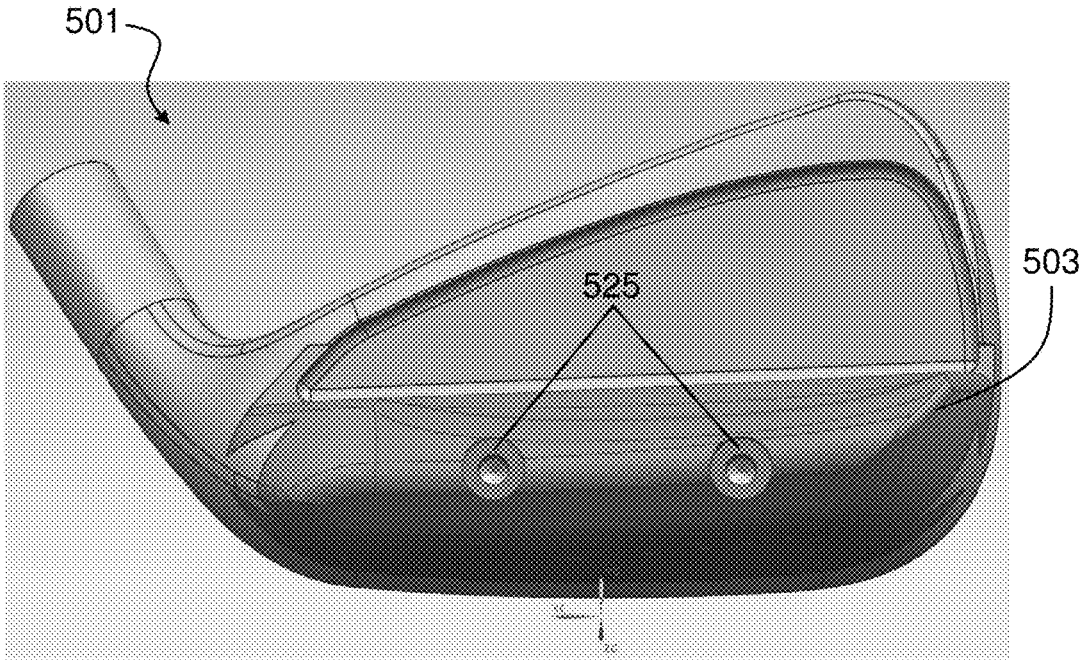
Figure 35C:
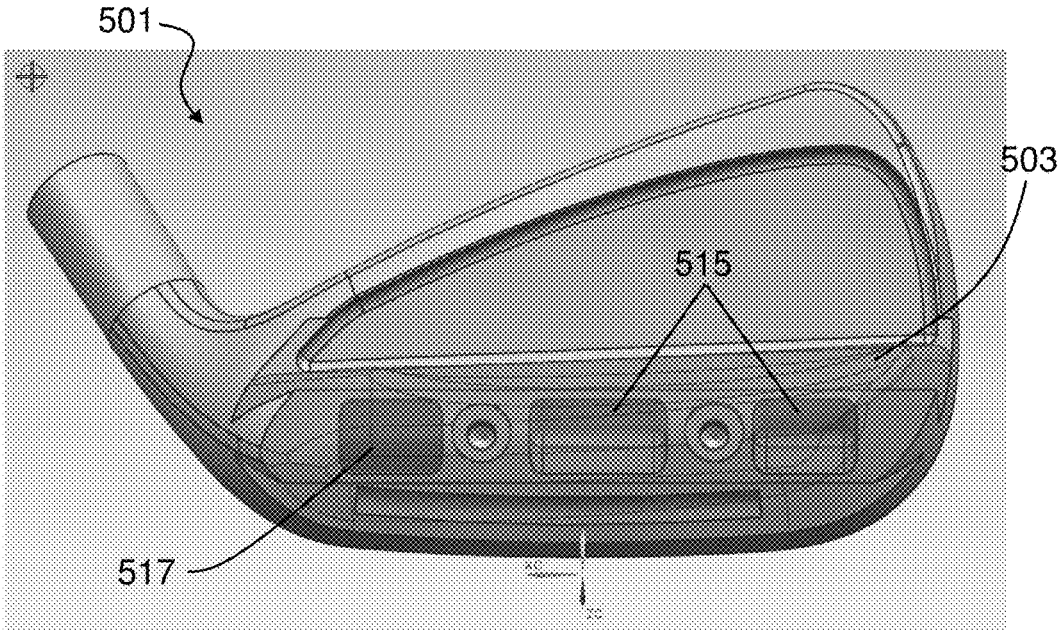

FIGS. 35A-35C show an iron-type club head 501 with an accessible interior. As shown, the club head 501 includes a removable component 503 (e.g., a slidable cover) that can provide functionality in a number of ways. For example, the slidable cover 503 may be used to enclose an interior portion of the club head body 505. The club head body 505 generally includes a heel 507, toe 509, and sole 511. The club head body 505 further includes a track 513 formed on a portion thereof. As shown, the track 513 is generally formed on a back portion of the body 505 adjacent to the sole 511 and extending in a direction from the heel 507 to the toe 509, substantially parallel to the sole 511. In other embodiments, the track 513 may be arranged in other positions and directions (e.g., vertically). The body 505 further includes one or more mount points 515 for coupling weight members 517 thereto. For example, as shown, the mount points 515 are in the form of recesses shaped and/or sized to receive associated weight members 517 therein. It should be noted, however, that the mount points 515 and weight members 517 may be in the form of any one of the embodiments previously described herein.

As shown, the track 513 is configured to receive a corresponding portion of the cover 503 so as to allow the cover 503 to be slidably mounted thereon. For example, the cover 503 generally includes a slot or channel 519 shaped and/or sized to receive the raised track 513, as indicated by arrow 521. It should be noted that in other embodiments, the track 513 may be in the form of a channel and the cover 503 may include a protrusion 519 to be received within the track 513. The cover 503 is thus slidably mounted to the club head 501 by way of the track 513 and channel 519 interface. The cover 503 is adapted to slide along the track either towards the heel 507 or towards the toe 509, as indicated by arrow 523, thereby allowing a golfer to completely enclose and secure weight members 517 within the mount points 515, and, when desired, remove the cover 503 to gain access to the weight member 517. The particular placement of the weight members 517 according any arrangement may have a particular effect on performance characteristics of the golf club head 501. For example, a golfer can place the weight members 517 in a desired arrangement that alters center of gravity, moment of inertia, and/or swing weight of the club head 501.

The cover 503 further includes one or more mounting portions 525 (e.g., bores) through which fasteners can be inserted and secured to corresponding mounting portions 527 formed on the club head body 503. For example, as shown in FIGS. 35B and 35C, when the cover 503 is in a closed position (e.g., cover 503 enclosing weight members 517 and mount points 515), a fastener (e.g., screw, bolt, or any other suitable fastener such as a barbed post, a cotter pin, or other binder) may further secure the cover 503 to the club head 501 in a closed position. Accordingly, when the fastener is in place, the cover 503 is held in place and the club head 501 can be used in playing golf. A golfer can use a tool, such as a specialty tool with a custom tip, to unfasten the fastener, and the golfer can release the cover 503 and slide to an open position to gain access to the mount points 515 and/or weight members 517 (e.g., add, remove, or exchange weights, alter configuration and placement of weights, etc.).

Figure 36A:
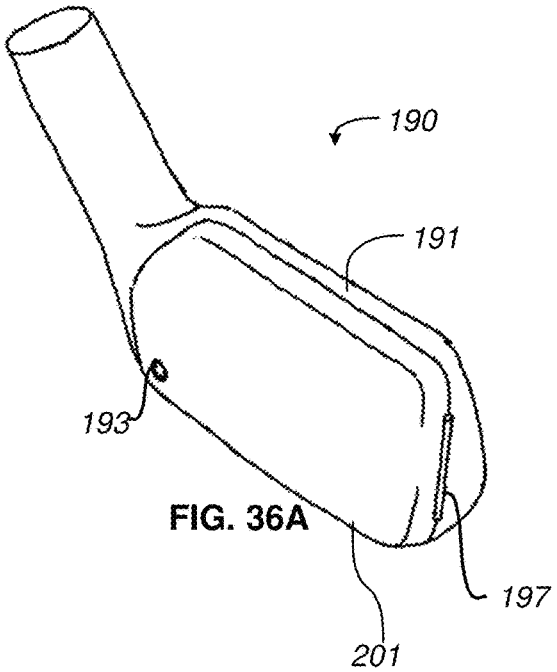
FIGS. 36A-36D show an iron-type club head with an openable member.
Figure 36B:
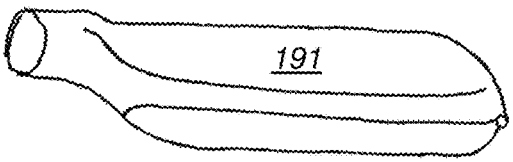
Figure 36C:
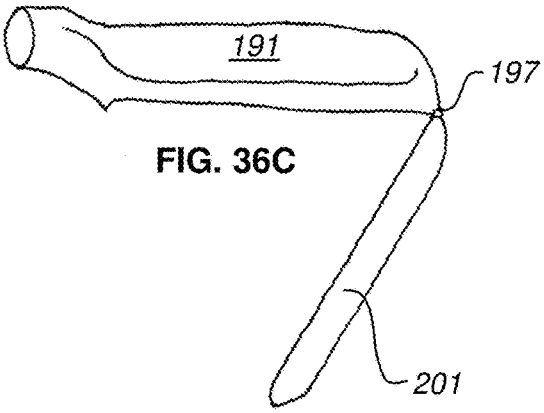
Figure 36D:
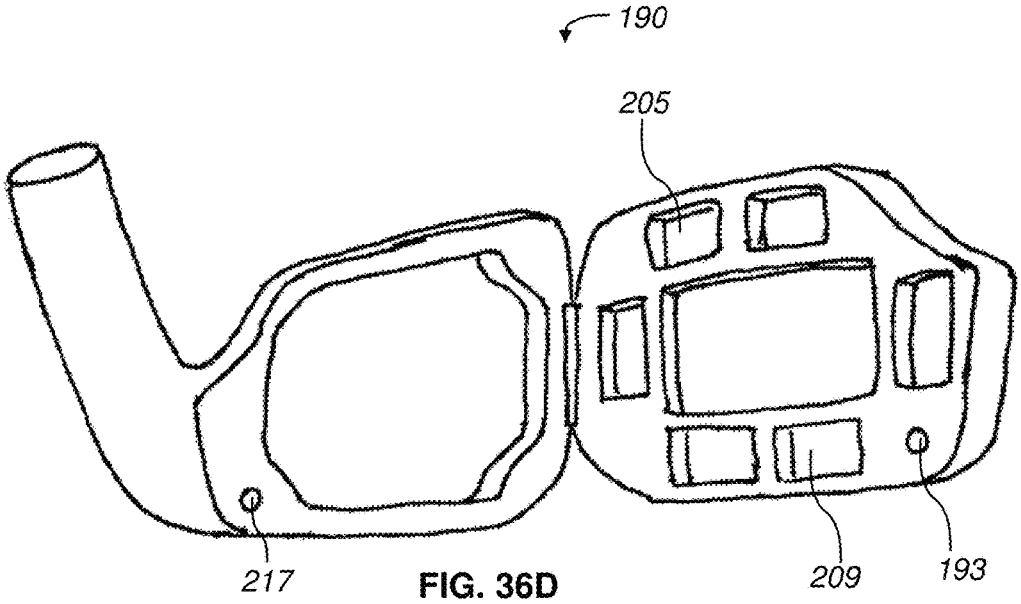

FIGS. 36A-36D show a club head 190 with an openable door 201 (e.g., a hinged cap) that can provide functionality in a number of ways. In some embodiments, FIGS. 36A-36D show a club head 190 with an openable door 201 that provides a mechanism for adjusting a club head center of gravity in a vertical direction. Member 201 is mounted on club head 190 via hinge 197. Member 201 optionally includes fastening mechanism 193 to maintain club head 190 in a closed configuration (as shown in FIGS. 36A and 36B). FIGS. 36C and 36D show club head 190 in an open configuration. Body member 191 can optionally include a component 217 of fastening mechanism 193. In some embodiments, fastening mechanism 193 includes a set screw (e.g., on openable door 201) and a threaded receiving hole (e.g., on body member 191). In some embodiments, fastening mechanism 193 includes a magnet such as, for example, a high powered magnet (e.g., a rare-earth element magnet).

Club head 390 includes a center of gravity that is adjustable in a vertical direction. In some embodiments, high port 205 and low port 209 are provided as recesses in door 201 (e.g., on an inside surface so that they are not visible when club head 190 is in a closed configuration). One or more weight members may be provided that mount in any of the ports. A weight member may be retained in a port by any suitable method. Suitable methods for retaining a weight member in a port include: dimensioning the weight and club head so that a back of the body member 191 holds the weight in place when club head 190 is in a closed configuration; adhesives; magnets (e.g., high powered magnets such as rare earth elements); a press-fit construction; a snap fit construction; one or more of a screw or similar fastener; spot-welding; or other similar methods.

By repositioning weight members among the ports depicted in FIG. 36D, a golfer may adjust a center of gravity in a vertical direction. In some embodiments, a door 201 further includes ports in a center, near a heel end, near a toe end, or anywhere else within.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A golf club head assembly comprising:

a club head body comprising a ball-striking face, a sole, a crown, and a hosel that together form a hollow, interior cavity of the club head; and a removable component configured to be removed from and re-attached to a mounting portion on the club head body, the removable component comprises:

a body comprising a substantially annular wall having external threading configured to engage internal threading of the mounting portion to releasably attach the removable component to the mounting portion; and a translucent or transparent material coupled to the body through which the interior cavity of the club head body is viewable when the removable component is attached to the mounting portion;

an electronic device configured to be releasably positioned within the interior cavity of the club head body and is fully removable therefrom;

wherein, when the removable component is removed from the mounting portion, the interior cavity of the club head body is accessible and an interior surface of at least one of the sole, the crown, and the ball-striking face within the interior cavity is accessible for the placement or removal of the electronic device.

2. The golf club head assembly of claim 1, wherein the electronic device is configured to collect information related to at least one of club head characteristics and club head performance.

3. The golf club head assembly of claim 2, wherein the club head characteristics comprise at least one of club type and club settings.

4. The golf club head assembly of claim 2, wherein the collected information related to club head performance comprises data associated with motion of the club head throughout a swing of the club head and during impact between the ball-striking face and a golf ball.

5. The golf club head assembly of claim 4, wherein the data comprises at least one of club head acceleration, translation motion of club head, club head vibration, club head shock, club head tilt, club head rotation in downward swing and upward swing, impact of a ball with the club face, angle of impact between the ball and the club face, ball speed, launch angle, ball spin, ball trajectory, shot distance, and hit or impact pattern.

6. The golf club head assembly of claim 2, wherein the electronic device is selected from the group consisting of an RFID tag, a battery, a solenoid, a motion sensor, an accelerometer, a gyroscope, a magnetometer, a switch, and a combination thereof.

7. The golf club head assembly of claim 2, wherein the electronic device is configured to wirelessly communicate and exchange collected data with a computing device.

8. The golf club head assembly of claim 1, wherein the mounting portion is positioned on the sole of the club head body.

9. The golf club head assembly of claim 1, wherein the mounting portion comprises an aperture.

10. The golf club head assembly of claim 9, wherein the aperture has an open area of at least 3 $cm^2$.

11. The golf club head assembly of claim 1, wherein, when the removable component is removed from the mounting portion, the interior cavity of the club head is accessible for the placement of or removal of an adjustment mechanism within the interior cavity.

12. The golf club head assembly of claim 11, wherein the adjustment mechanism is a mass adjustment mechanism configured for adjusting a mass distribution of the club head.

13. The golf club head assembly of claim 11, wherein the adjustment mechanism is a sound tuning member for adjusting sound properties of the club head.

* * * * *